US008305273B2

(12) United States Patent
Cheng et al.

(10) Patent No.: US 8,305,273 B2
(45) Date of Patent: Nov. 6, 2012

(54) DUAL-BAND DUAL-ANTENNA STRUCTURE

(75) Inventors: Shih-Chieh Cheng, Tainan County (TW); Hsin-Chieh Peng, Miaoli County (TW)

(73) Assignee: Arcadyan Technology Corporation, Hsinchu (TW)

( * ) Notice: Subject to any disclaimer, the term of this patent is extended or adjusted under 35 U.S.C. 154(b) by 327 days.

(21) Appl. No.: 12/857,033

(22) Filed: Aug. 16, 2010

(65) Prior Publication Data

US 2011/0037660 A1 Feb. 17, 2011

(30) Foreign Application Priority Data

Aug. 14, 2009 (TW) ..... 98127427 A

(51) Int. Cl.
*H01Q 5/00* (2006.01)

(52) U.S. Cl. ..... 343/700 MS; 343/893; 343/904; 343/908

(58) Field of Classification Search ..... 343/700 MS, 343/893, 904, 907–908
See application file for complete search history.

(56) References Cited

U.S. PATENT DOCUMENTS

| | | | | |
|---|---|---|---|---|
| 7,057,565 | B1 * | 6/2006 | Liu | 343/700 MS |
| 7,586,448 | B2 * | 9/2009 | Wei | 343/702 |
| 2008/0191957 | A1 * | 8/2008 | Chang | 343/845 |
| 2008/0316111 | A1 * | 12/2008 | Aoyama et al. | 343/700 MS |
| 2010/0039330 | A1 * | 2/2010 | Chien et al. | 343/700 MS |
| 2010/0045564 | A1 * | 2/2010 | Chih-Yung et al. | 343/893 |

* cited by examiner

*Primary Examiner* — Jason M Crawford
(74) *Attorney, Agent, or Firm* — Rabin & Berdo, P.C.

(57) ABSTRACT

A dual-band dual-antenna structure is provided. The dual-band dual-antenna structure comprises a substrate, a first antenna and a second antenna. The substrate comprises a first signal transport layer and a second signal transport layer, wherein the second signal transport layer is not coplanar with the first signal transport layer. The first antenna is disposed on the first signal transport layer and comprises a first U-shaped radiation element and a first polygon radiation element. The first polygon radiation element is disposed in an opening of the first U-shaped radiation element. The second antenna is disposed on the second signal transport layer but does not overlap under the first antenna. The second antenna comprises a second U-shaped radiation element and a second polygon radiation element. The second polygon radiation element is disposed in an opening of the second U-shaped radiation element.

19 Claims, 39 Drawing Sheets

| Frequency(GHz) | | | 2.4 | 2.45 | 2.5 | 4.9 | 5.15 | 5.25 | 5.35 | 5.45 | 5.75 | 5.85 |
|---|---|---|---|---|---|---|---|---|---|---|---|---|
| antenna 120 | first placement state | peak gain(dBi) | -3.22 | -1.88 | -1.92 | 1.27 | 2.89 | 3.31 | 3.21 | 3.38 | 1.97 | 3.85 |
| | | average gain(dBi) | -6.43 | -5.44 | -5.73 | -4.35 | -2.93 | -2.63 | -2.63 | -2.17 | -2.01 | -0.25 |
| | second placement state | peak gain(dBi) | -2.69 | -2.64 | -2.53 | 0.06 | 2.26 | 2.59 | 2.96 | 3.57 | 1.93 | 3.40 |
| | | average gain(dBi) | -6.17 | -5.65 | -5.83 | -4.28 | -2.17 | -1.85 | -1.65 | -1.12 | -1.63 | 0.13 |
| | third placement state | peak gain(dBi) | -2.34 | -1.93 | -1.53 | -0.44 | 0.84 | 1.69 | 1.69 | 2.14 | 1.03 | 2.15 |
| | | average gain(dBi) | -4.76 | -4.27 | -4.11 | -3.80 | -1.96 | -1.28 | -0.92 | -0.61 | -1.24 | 0.01 |
| antenna 130 | first placement state | peak gain(dBi) | -3.11 | -2.74 | -2.19 | 0.92 | 1.75 | 1.96 | 2.24 | 2.79 | 2.11 | 3.84 |
| | | average gain(dBi) | -6.33 | -5.71 | -5.62 | -4.91 | -3.07 | -2.84 | -2.53 | -1.94 | -2.16 | -0.32 |
| | second placement state | peak gain(dBi) | -3.28 | -2.43 | -2.45 | -0.05 | 1.01 | 1.24 | 1.33 | 1.71 | 1.44 | 3.23 |
| | | average gain(dBi) | -6.01 | -5.22 | -5.26 | -4.20 | -2.49 | -2.12 | -2.36 | -2.40 | -2.26 | -0.36 |
| | third placement state | peak gain(dBi) | -2.26 | -1.75 | -1.74 | -2.94 | -0.78 | 1.16 | 1.82 | 2.15 | 0.84 | 1.63 |
| | | average gain(dBi) | -5.16 | -4.87 | -4.51 | -5.83 | -3.01 | -1.84 | -1.16 | -0.83 | -2.48 | -1.56 |

FIG. 70

DUAL-BAND DUAL-ANTENNA STRUCTURE

This application claims the benefit of Taiwan application Serial No. 98127427, filed Aug. 14, 2009, the subject matter of which is incorporated herein by reference.

BACKGROUND OF THE INVENTION

1. Field of the Invention

The invention relates in general to an antenna, and more particularly to a dual-band dual-antenna structure.

2. Description of the Related Art

Along with the rapid advance in computer and wireless communication technology, wireless area network (WLAN) has been widely used in people's everydayness. Nowadays, many electronic devices can be connected to the WLAN via a universal serial bus (USB) wireless network card.

However, as the wireless area network has different protocols, the corresponding operating frequency bands also vary. Thus, how to provide a USB wireless network card operated at dual operating frequency bands has become an imminent issue. As the design of electronic devices is directed towards slimness, lightweight and compactness, the size of the USB wireless network card is restricted to be as big as a USB flash drive. Under such circumstance, the size of the antenna disposed in USB wireless network card is restricted to a certain level. As a result, the operatable frequency band of the antenna is also restricted.

SUMMARY OF THE INVENTION

The invention is directed to a dual-band dual-antenna structure having at least the following advantages:

Firstly, providing dual operating frequency bands;

Secondly, being applicable to wireless area network;

Thirdly, reducing the occupied area of antenna on a substrate and conforming to the current of reduced volume required of electronic devices; and Fourthly, reducing the complexity and difficulty in circuit layout due to the reduced area occupied by the antenna.

According to a first aspect of the present invention, a dual-band dual-antenna structure is provided. The dual-band dual-antenna structure comprises a substrate, a first antenna and a second antenna. The substrate comprises a first signal transport layer and a second signal transport layer, wherein the second signal transport layer is not coplanar with the first signal transport layer.

The first antenna is disposed on the first signal transport layer and comprises a first U-shaped radiation element and a first polygon radiation element. The first U-shaped radiation element comprises a first band radiation portion, a second band radiation portion and a third band radiation portion. One end of the second band radiation portion is connected to one end of the first band radiation portion so as to form a first right angle. One end of the third band radiation portion is connected to the other end of the second band radiation portion so as to form a second right angle. The length of the first band radiation portion is larger than that of the third band radiation portion. The first band radiation portion, the second band radiation portion and the third band radiation portion together form a first opening opposite to the second band radiation portion. The first polygon radiation element is disposed in the first opening and comprises a first lateral side and a second lateral side. The first lateral side is opposite to the first right angle, wherein one end of the first lateral side is connected to the other end of the third band radiation portion, and the first lateral side is connected to the edge of the third band radiation portion to form a first obtuse angle facing the first opening. The second lateral side is parallel to the first band radiation portion, wherein one end of the second lateral side is connected to the other end of the first lateral side. The first U-shaped radiation element is operated at a first frequency band, and the first polygon radiation element is operated at a second frequency band, wherein the frequency of the second frequency band is larger than that of the first frequency band.

The second antenna is disposed on the second signal transport layer but does not overlap under the first antenna. The second antenna comprises a second U-shaped radiation element and a second polygon radiation element. The second U-shaped radiation element comprises a fourth band radiation portion, a fifth band radiation portion and a sixth band radiation portion. One end of the fifth band radiation portion is connected to one end of the fourth band radiation portion so as to form a third right angle. One end of the sixth band radiation portion is connected to the other end of the fifth band radiation portion so as to form a fourth right angle. The length of the fourth band radiation portion is larger than that of the sixth band radiation portion. The fourth band radiation portion, the fifth band radiation portion and the sixth band radiation portion together form a second opening opposite to the fifth band radiation portion. The second polygon radiation element is disposed in the second opening and comprises a third lateral side and a fourth lateral side. The third lateral side is opposite to the third right angle, wherein one end of the third lateral side is connected to the other end of the sixth band radiation portion, and the third lateral side is connected to the edge of the sixth band radiation portion to form a second obtuse angle facing the second opening. The fourth lateral side is parallel to the fourth band radiation portion, wherein one end of the fourth lateral side is connected to the other end of the third lateral side. The second U-shaped radiation element is operated at a third frequency band, and the second polygon radiation element is operated at a fourth frequency band, wherein the frequency of the fourth frequency band is larger than the frequency of the third frequency band.

Preferably, the first antenna and the second antenna are respectively disposed on the first signal transport layer and the second signal transport layer without overlapping each other.

Preferably, the first antenna and the second antenna respectively are symmetrically disposed on the first signal transport layer and the second signal transport layer at equal proportion. Meanwhile, the first frequency band is equal to the third frequency band, and the second frequency band is equal to the fourth frequency band, so that the dual-band dual-antenna structure of the invention obtains better property of antenna transmission.

The invention will become apparent from the following detailed description of the preferred but non-limiting embodiments. The following description is made with reference to the accompanying drawings.

BRIEF DESCRIPTION OF THE DRAWINGS

FIG. 70 shows a table of peak gain and average gain of antenna 120 and antenna 130 in the first placement state, the second placement state and the third placement state.

DETAILED DESCRIPTION OF THE INVENTION

As the design of wireless communication device is currently directed towards slimness, lightweight and compactness, how to provide a small-sized dual-band antenna satisfying the above requirements has become an imminent challenge. Thus, the invention provides a dual-band dual-antenna structure which comprises a substrate, a first antenna and a second antenna. The substrate comprises a first signal transport layer and a second signal transport layer which is not coplanar with the first signal transport layer.

The features of the invention are elaborated in a number of embodiments below.

First Embodiment

Figure 1:
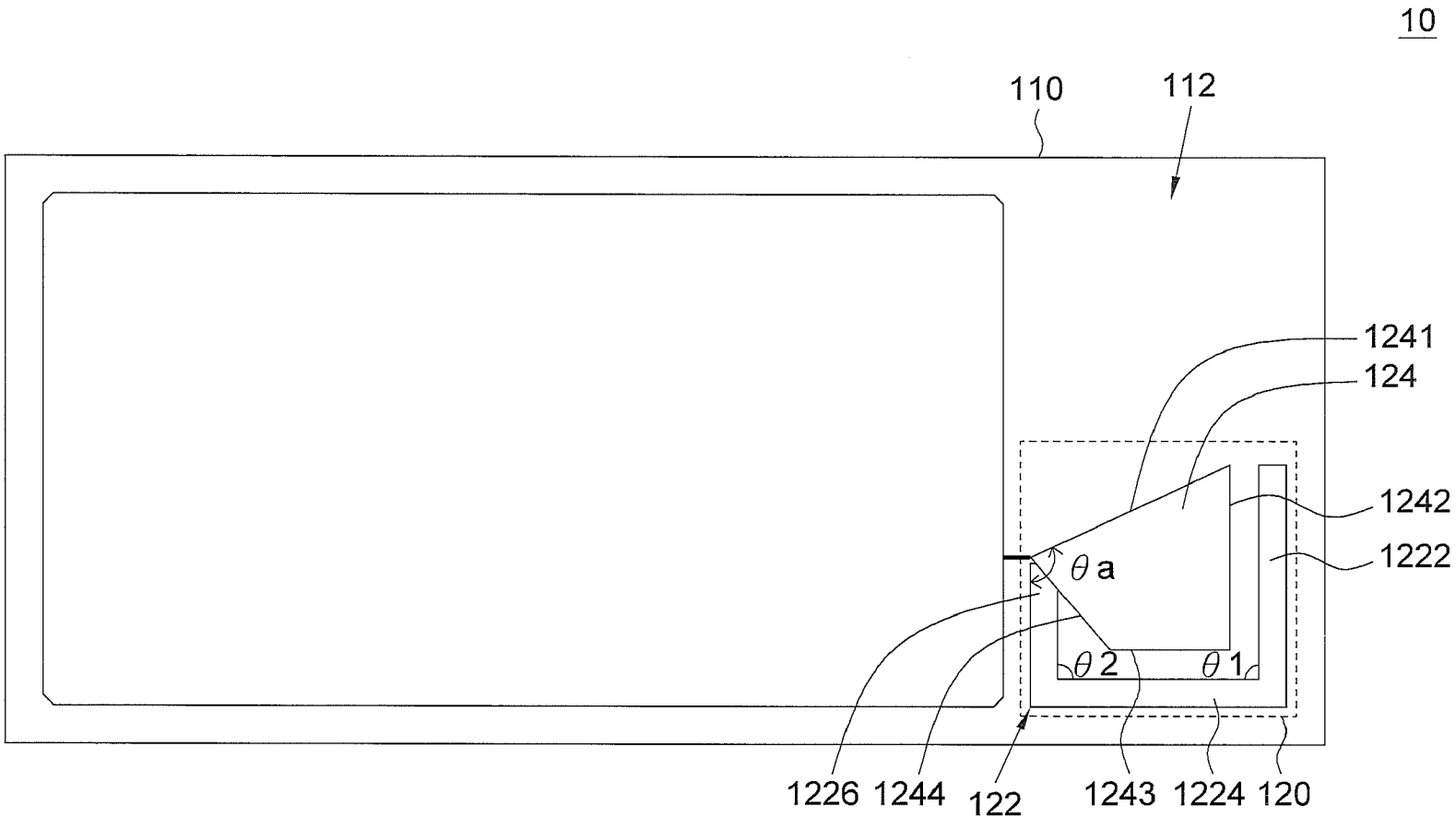
FIG. 1 shows a top view of a dual-band dual-antenna structure according to a first embodiment of the invention.
Figure 2:
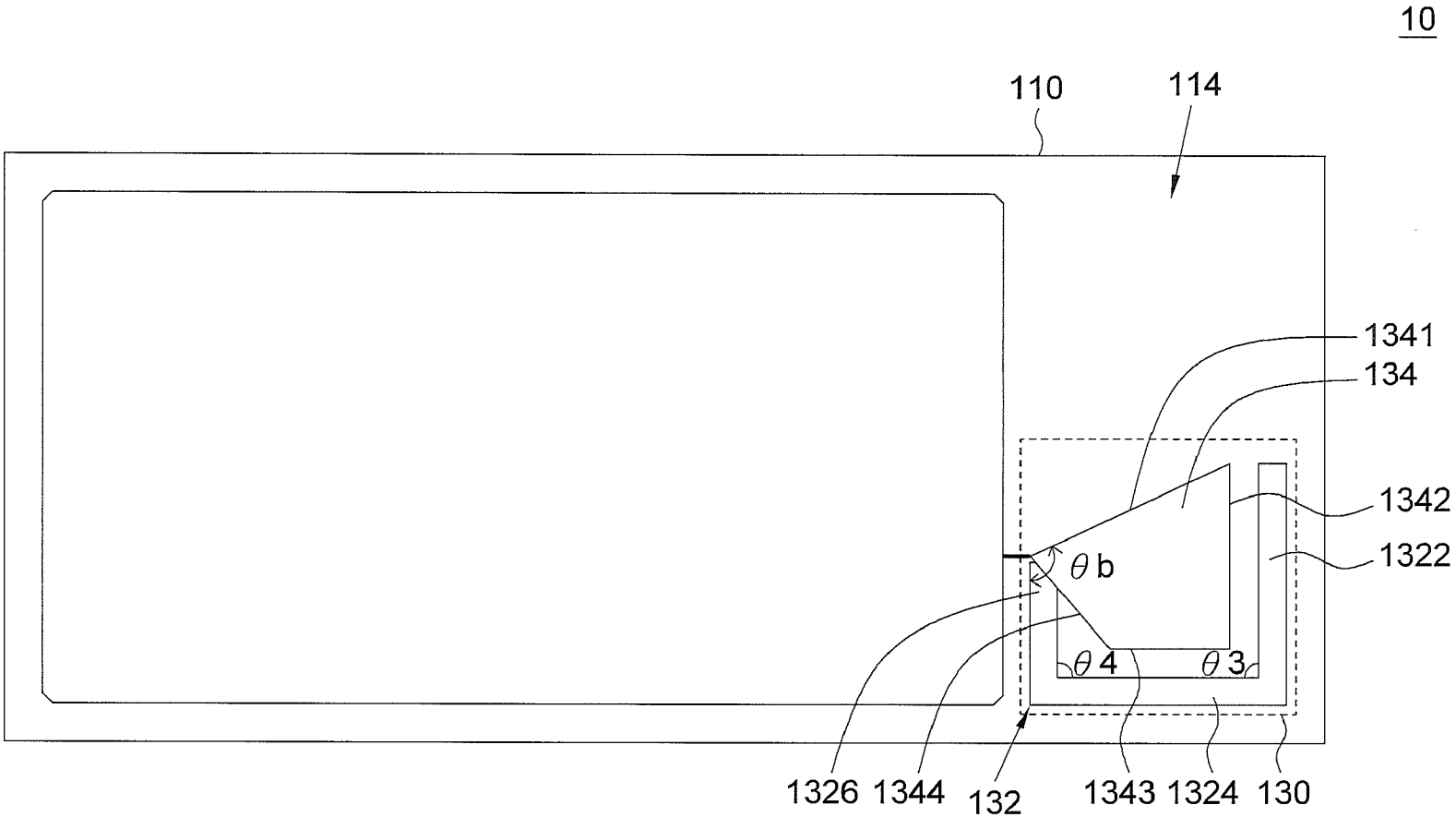
FIG. 2 shows an upward view of a dual-band dual-antenna structure according to a first embodiment of the invention.

Referring to both FIG. 1 and FIG. 2. FIG. 1 shows a top view of a dual-band dual-antenna structure according to a first embodiment of the invention. FIG. 2 shows an upward view of a dual-band dual-antenna structure according to a first embodiment of the invention. The dual-band dual-antenna structure 10 is used in wireless communication devices such as universal serial bus (USB) dual-band wireless network card. The dual-band dual-antenna structure 10 comprises a substrate 110, an antenna 120 and an antenna 130. The areas of the antenna 120 and the antenna 130 are preferably smaller than 10 mm×10 mm. The substrate 110 comprises a signal transport layer 112 and a signal transport layer 114, wherein the signal transport layer 114 is not coplanar with the signal transport layer 112. The area of the substrate 110 is the same with that of a USB flash drive for example. In the first embodiment, the signal transport layer 112 is located on the top surface of the substrate 110 and the signal transport layer 114 is located on the bottom surface of the substrate 110.

The antenna 120 is disposed on signal transport layer 112 and comprises a U-shaped radiation element 122 and a polygon radiation element 124. In the first embodiment, the polygon radiation element 124 is exemplified by a protruded quadrangle. The U-shaped radiation element 122 is operated at a first frequency band, wherein the first frequency band such as ranges from 2.4 to 2.5 GHz. The polygon radiation element 124 is operated at the second frequency band, wherein the frequency of the second frequency band is larger than that of the first frequency band, and the second frequency band such as ranges from 4.9 GHz to 5.85 GHz. A similar L-shaped slit is formed between the U-shaped radiation element 122 and the polygon radiation element 124. The U-shaped radiation element 122 comprises a band radiation portion 1222, a band radiation portion 1224 and a band radiation portion 1226, wherein the length of the band radiation portion 1222 is larger than that of the band radiation portion 1226. One end of the band radiation portion 1224 is connected to one end of the band radiation portion 1222 so as to form a right angle θ1. One end of the band radiation portion 1226 is connected to the other end of the band radiation portion 1224 so as to form a right angle θ2. The band radiation portion 1222, the band radiation portion 1224 and the band radiation portion 1226 together form a first opening. The first polygon radiation element 124 is disposed in the opening and comprises four lateral sides 1241~1244. The lateral side 1241 is opposite to right angle θ1. One end of the lateral side 1241 is connected to the other end of the band radiation portion 1226. The lateral side 1241 is connected to the edge of the band radiation portion 1226 to form an obtuse angle θa facing the first opening. The lateral side 1242 is parallel to the band radiation portion 1222. One end of the lateral side 1242 is connected to the other end of the lateral side 1241. The lateral side 1243 is parallel to the band radiation portion 1224. One end of the lateral side 1243 is connected to the other end of the lateral side 1242. The lateral side 1244 is opposite to right angle θ2. One end of the lateral side 1244 is connected to the other end of the lateral side 1243, and the other end of the lateral side 1244 is connected to one end of the lateral side 1241, so that the polygon radiation element 124 forms a protruded quadrangle.

The antenna 130 is disposed on the signal transport layer 114 but does not overlap the antenna 120 vertically. The antenna 130 comprises a U-shaped radiation element 132 and a polygon radiation element 134. In the first embodiment, the polygon radiation element 134 is exemplified by a protruded quadrangle. The U-shaped radiation element 132 is operated at the third frequency band, wherein the third frequency band such as ranges from 2.4 to 2.5 GHz. The polygon radiation element 134 is operated at the fourth frequency band, wherein the frequency of the fourth frequency band is larger than the frequency of the third frequency band, and the fourth frequency band such as ranges from 4.9 GHz to 5.85 GHz. A similar L-shaped slit is formed between the U-shaped radiation element 132 and the polygon radiation element 134. The U-shaped radiation element 132 comprises a band radiation portion 1322, a band radiation portion 1324 and a band radiation portion 1326, wherein the length of the band radiation portion 1322 is larger than is larger than that of band radiation portion 1326. One end of the band radiation portion 1324 is connected to one end of the band radiation portion 1322 so as to form right angle θ3. One end of band radiation portion 1326 is connected to the other end of the band radiation portion 1324 so as to form a right angle θ4. The band radiation portion 1322, the band radiation portion 1324 and the band radiation portion 1326 together form a second opening. The polygon radiation element 134 is disposed in the second opening and comprises four lateral sides 1341~1344. The lateral side 1341 is opposite to the right angle θ3. One end of the lateral side 1341 is connected to the other end of the band radiation portion 1326. The lateral side 1341 is connected to the edge of the band radiation portion 1326 to form an obtuse angle θb facing the second opening. The lateral side 1342 is parallel to the band radiation portion 1322. One end of the lateral side 1342 is connected to the other end of the lateral side 1341. The lateral side 1343 is parallel to the band radiation portion 1324. One end of the lateral side 1343 is connected to the other end of the lateral side 1342. The lateral side 1344 is opposite to the right angle θ4. One end of the lateral side 1344 is connected to the other end of the lateral side 1343, and the other end of lateral side 1344 is connected to one end of the lateral side 1341, so that the polygon radiation element 134 forms a protruded quadrangle.

The antenna 120 or the antenna 130 is preferably disposed at a corner of the substrate 110, and the antenna 120 and the antenna 130 are preferably disposed in symmetry at equal proportion so as to avoid complexity in the design of circuit layout. Besides, as the antenna 120 and the antenna 130 are respectively disposed on the signal transport layer 112 and the signal transport layer 114 which are not coplanar and not overlapping vertically, the coupling effect between the antenna 120 and the antenna 130 is thus suppressed.

The USB dual-band wireless network card with dual-band dual-antenna structure 10 is disclosed below for elaborating the functions of the dual-band dual-antenna structure 10. Also, the VSWR measurement chart of and the antenna pattern chart are disclosed below.

Figure 5:
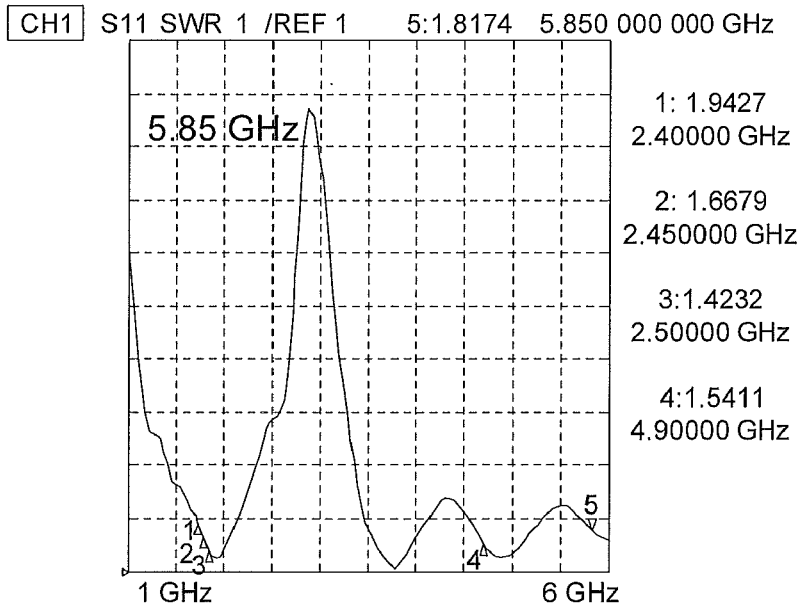
FIG. 5 shows a VSWR measurement chart of antenna 120.
Figure 6:
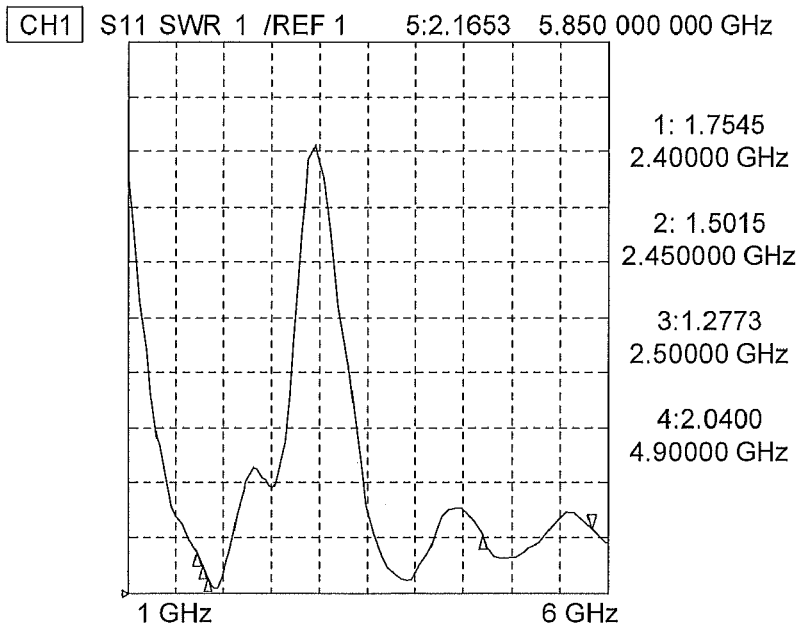
FIG. 6 shows a VSWR measurement chart of antenna 130.
Figure 7:
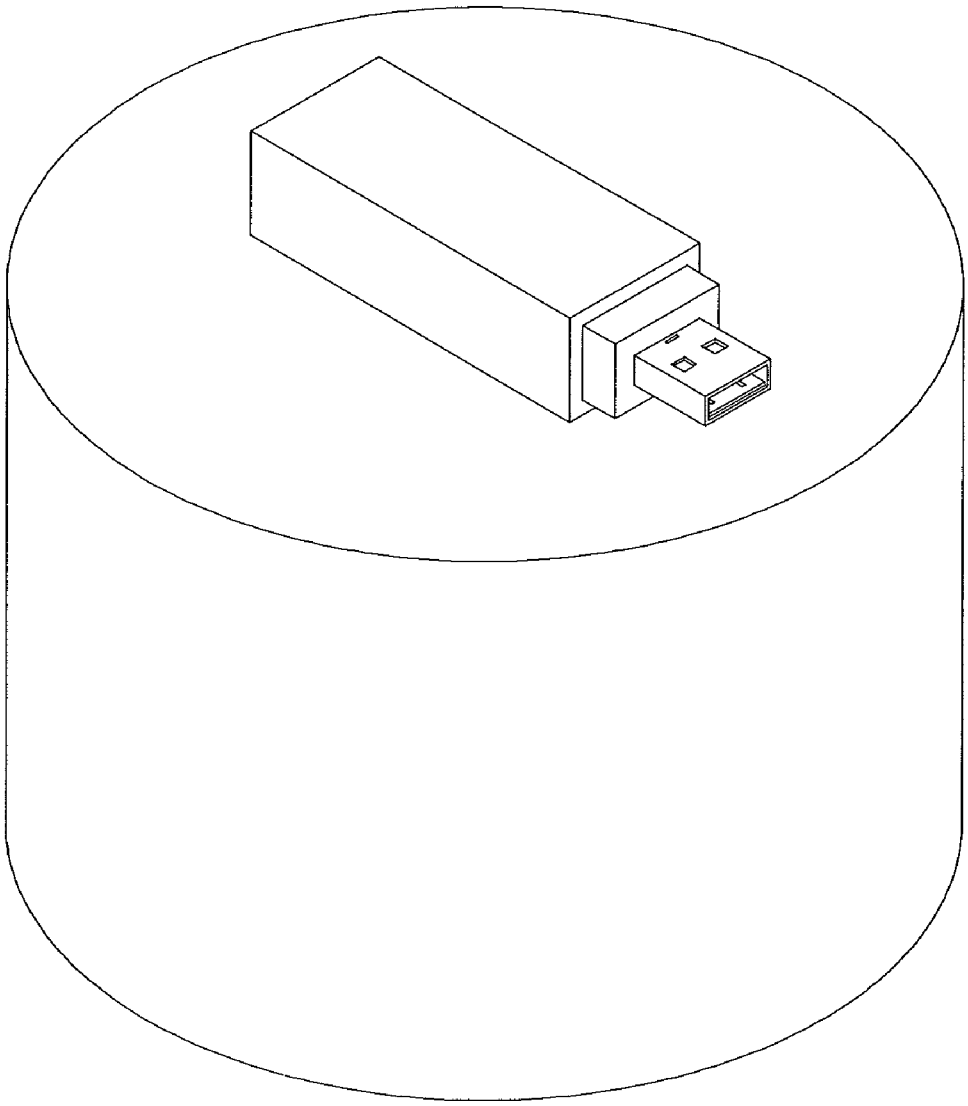
FIG. 7 shows a dual-band dual-antenna structure being in the first placement state.
Figure 8:
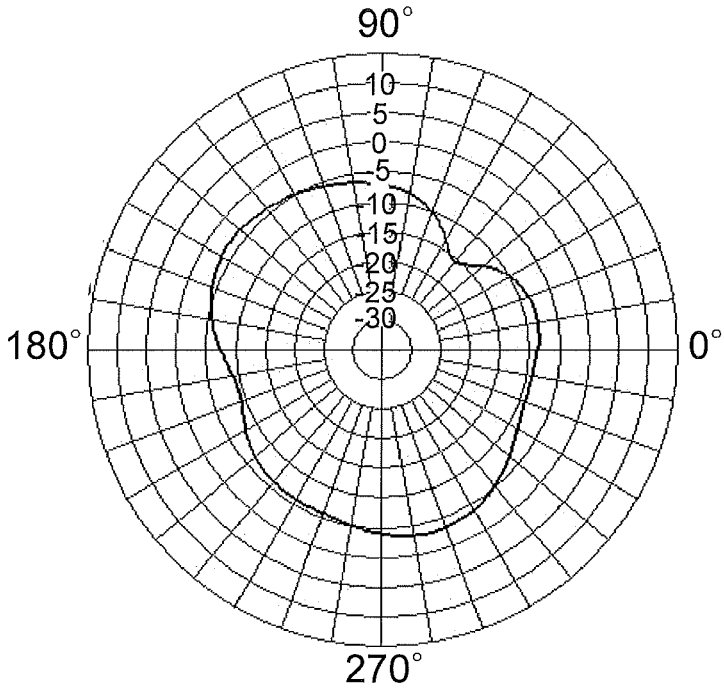
FIG. 8 shows a VSWR measurement chart of antenna 120 being in the first placement state and operated at 2.4 GHz.
Figure 9:
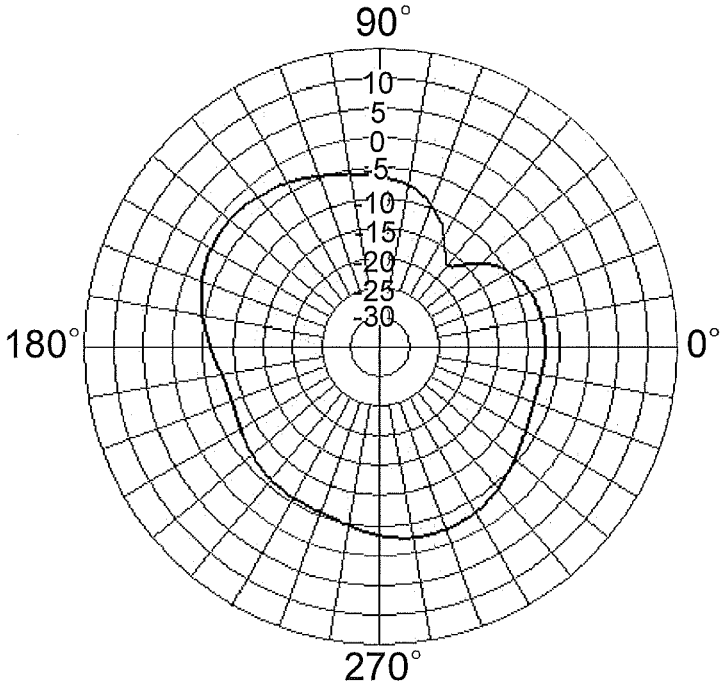
FIG. 9 shows a VSWR measurement chart of antenna 120 being in the first placement state and operated at 2.45 GHz.
Figure 10:
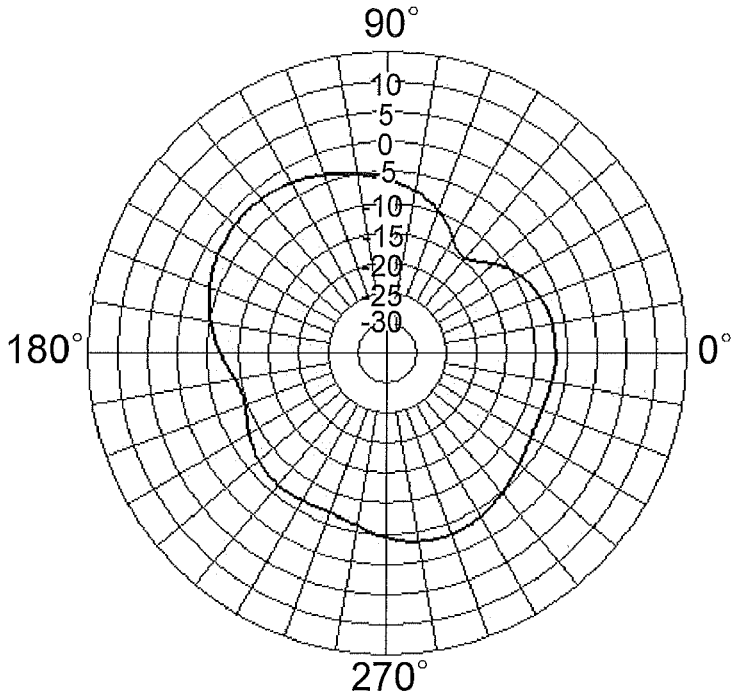
FIG. 10 shows a VSWR measurement chart of antenna 120 being in the first placement state and operated at 2.5 GHz.
Figure 11:
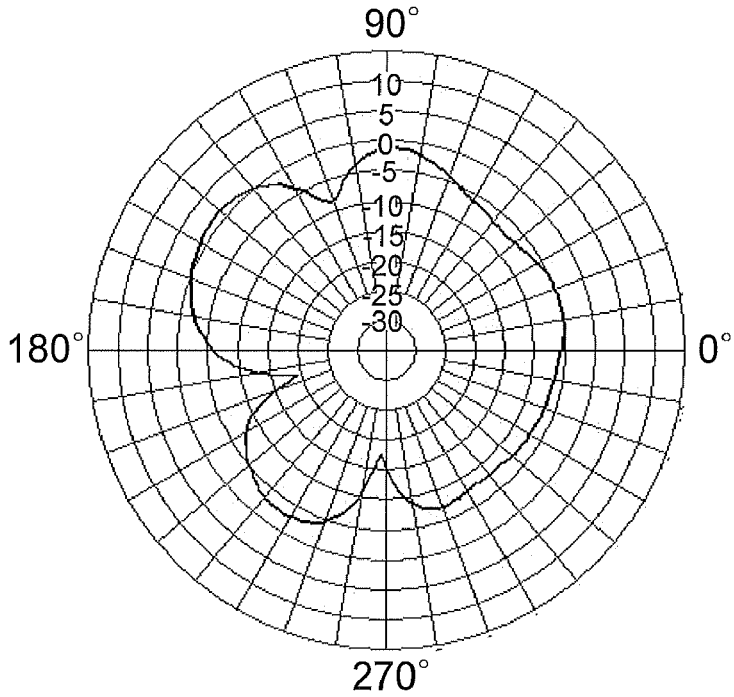
FIG. 11 shows a VSWR measurement chart of antenna 120 being in the first placement state and operated at 4.9 GHz.
Figure 12:
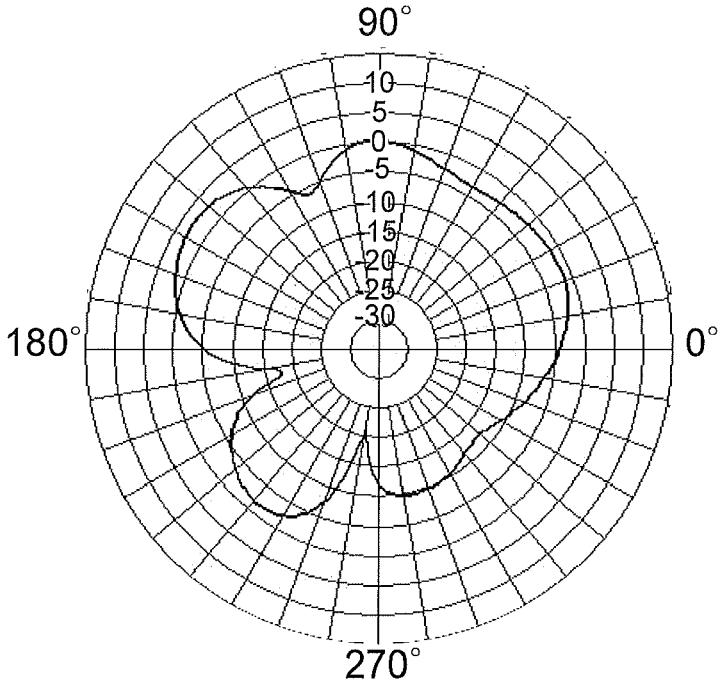
FIG. 12 shows a VSWR measurement chart of antenna 120 being in the first placement state and operated at 5.15 GHz.
Figure 13:
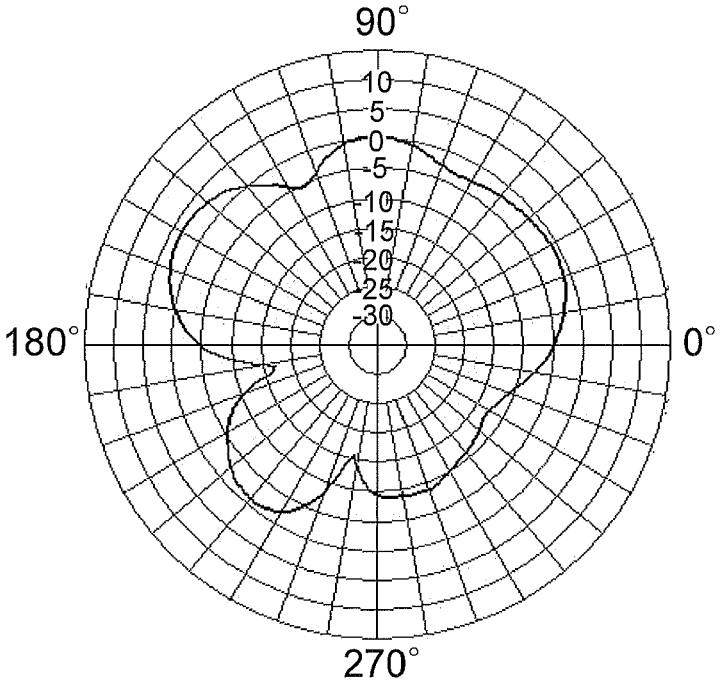
FIG. 13 shows a VSWR measurement chart of antenna 120 being in the first placement state and operated at 5.25 GHz.
Figure 14:
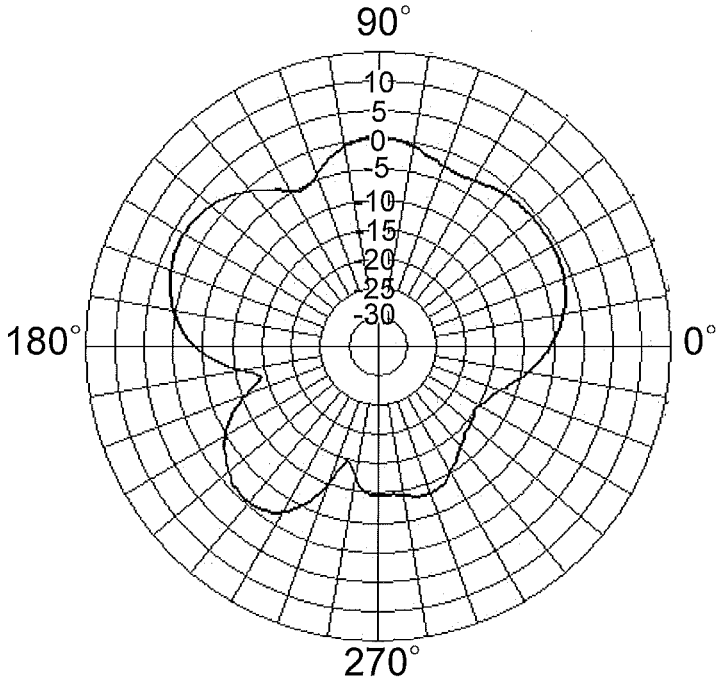
FIG. 14 shows a VSWR measurement chart of antenna 120 being in the first placement state and operated at 5.35 GHz.
Figure 15:
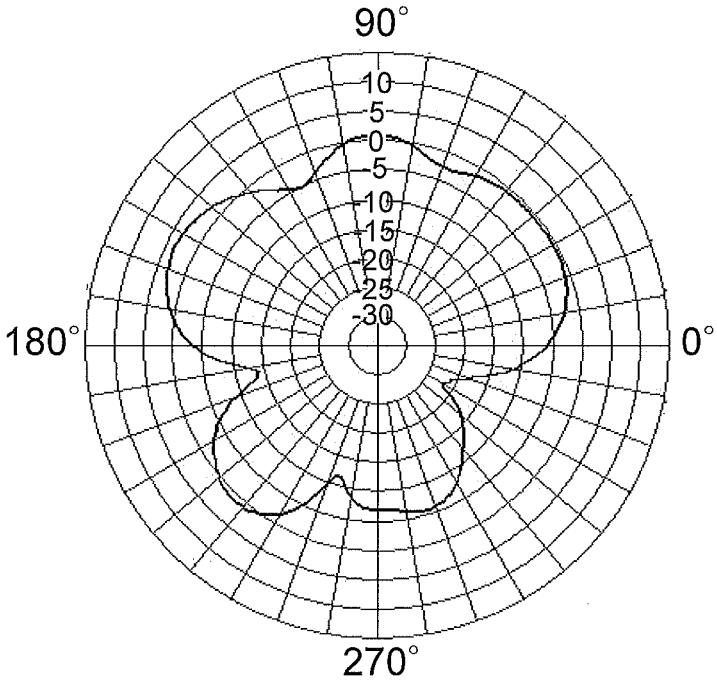
FIG. 15 shows a VSWR measurement chart of antenna 120 being in the first placement state and operated at 5.45 GHz.
Figure 16:
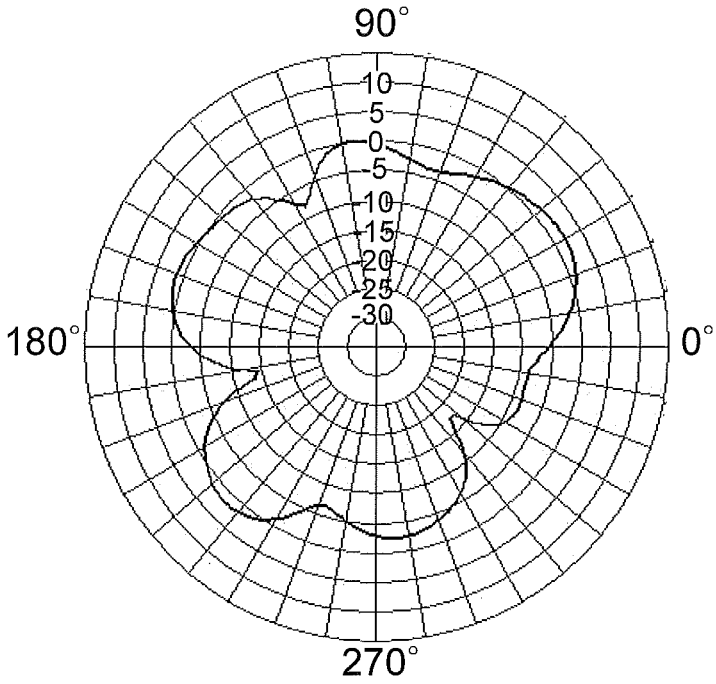
FIG. 16 shows a VSWR measurement chart of antenna 120 being in the first placement state and operated at 5.75 GHz.
Figure 17:
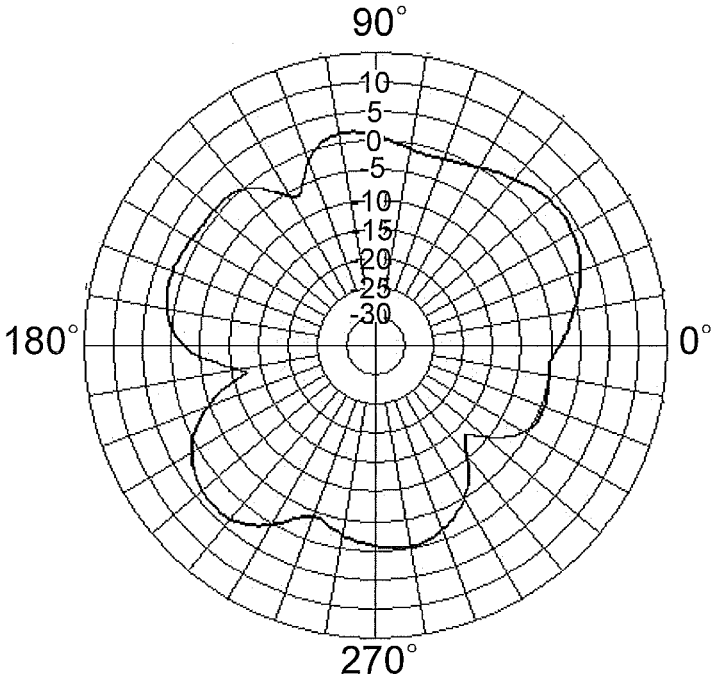
FIG. 17 shows a VSWR measurement chart of antenna 120 being in the first placement state and operated at 5.85 GHz.
Figure 18:
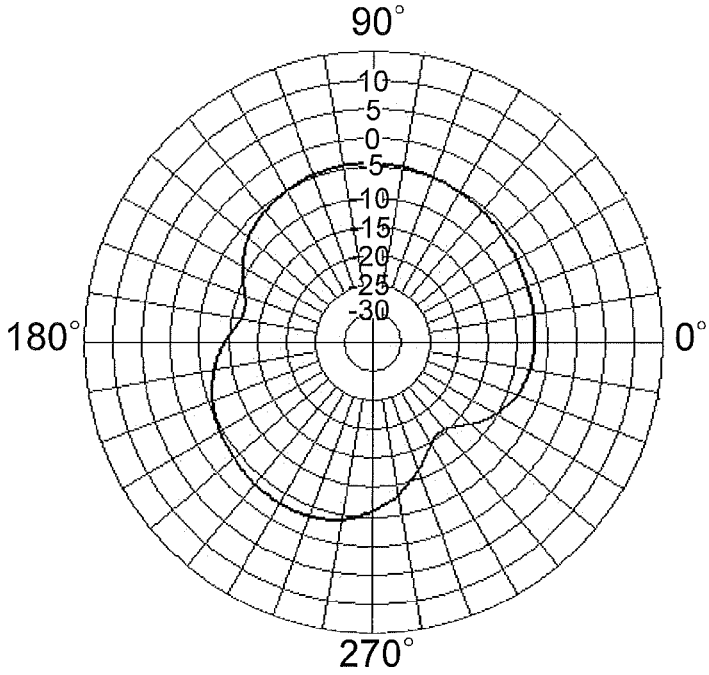
FIG. 18 shows a VSWR measurement chart of antenna 130 being in the first placement state and operated at 2.4 GHz.
Figure 19:
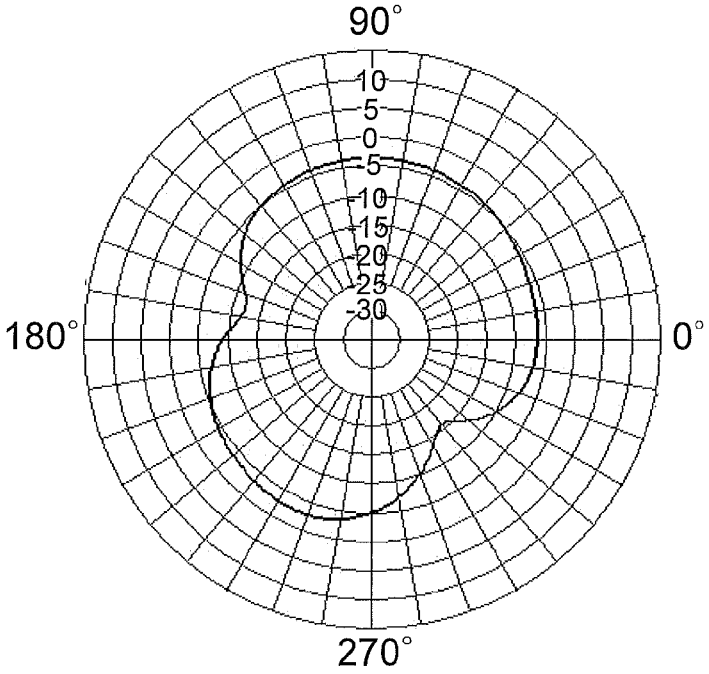
FIG. 19 shows a VSWR measurement chart of antenna 130 being in the first placement state and operated at 2.45 GHz.
Figure 20:
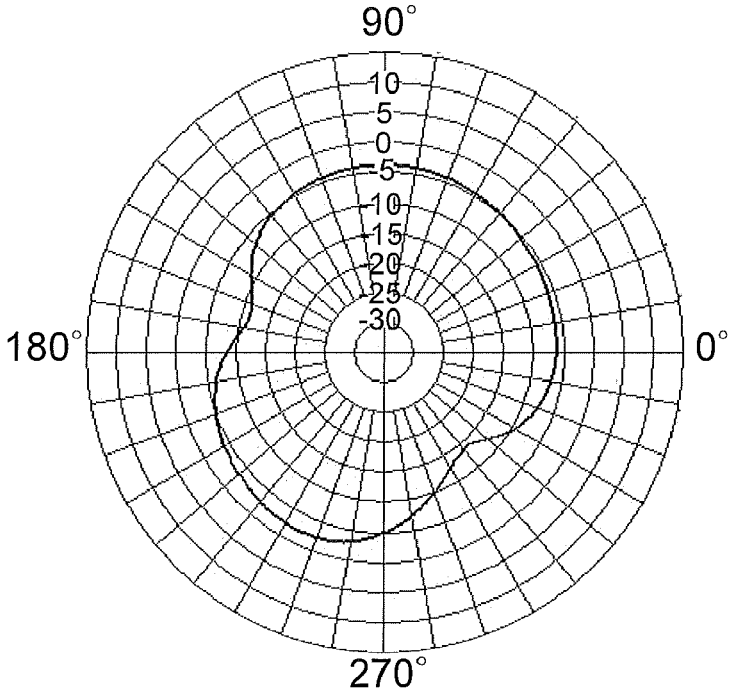
FIG. 20 shows a VSWR measurement chart of antenna 130 being in the first placement state and operated at 2.5 GHz.
Figure 21:
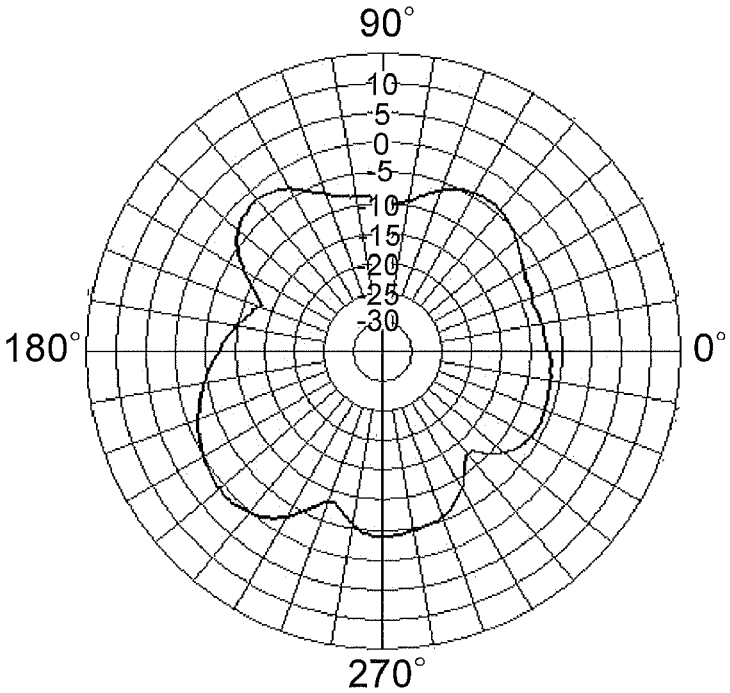
FIG. 21 shows a VSWR measurement chart of antenna 130 being in the first placement state and operated at 4.9 GHz.
Figure 22:
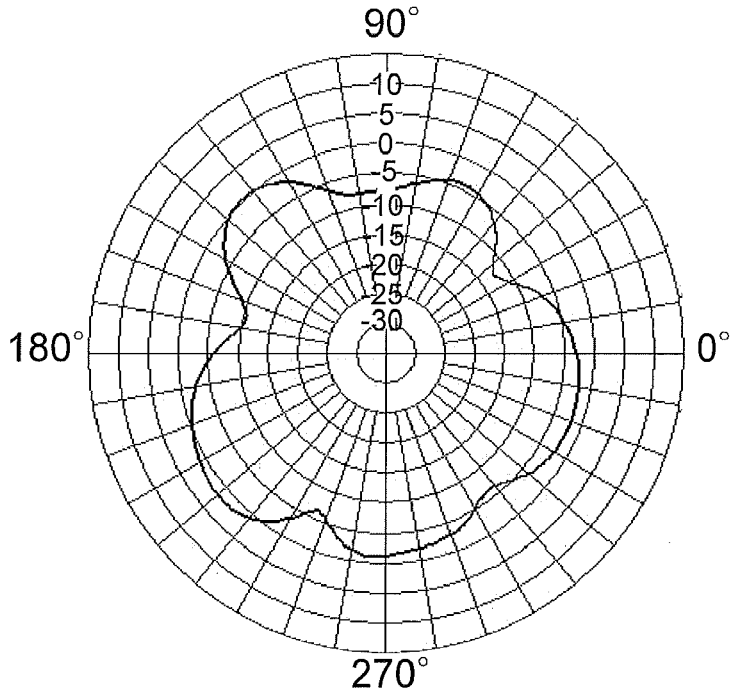
FIG. 22 shows a VSWR measurement chart of antenna 130 being in the first placement state and operated at 5.15 GHz.
Figure 23:
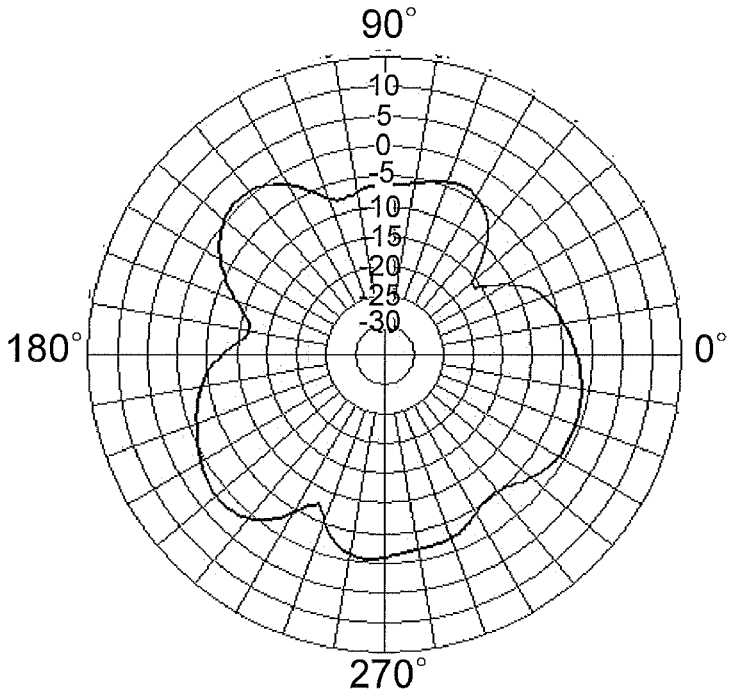
FIG. 23 shows a VSWR measurement chart of antenna 130 being in the first placement state and operated at 5.25 GHz.
Figure 24:
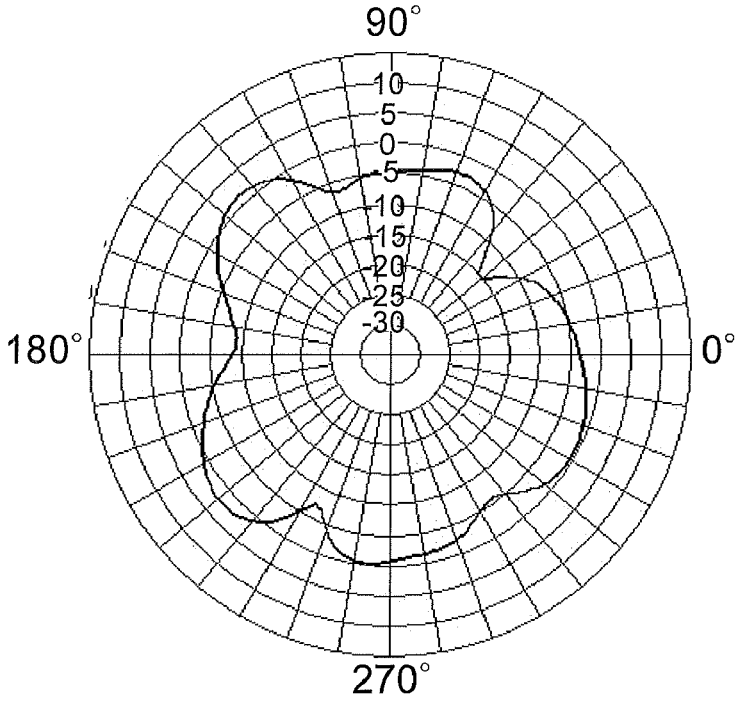
FIG. 24 shows a VSWR measurement chart of antenna 130 being in the first placement state and operated at 5.35 GHz.
Figure 25:
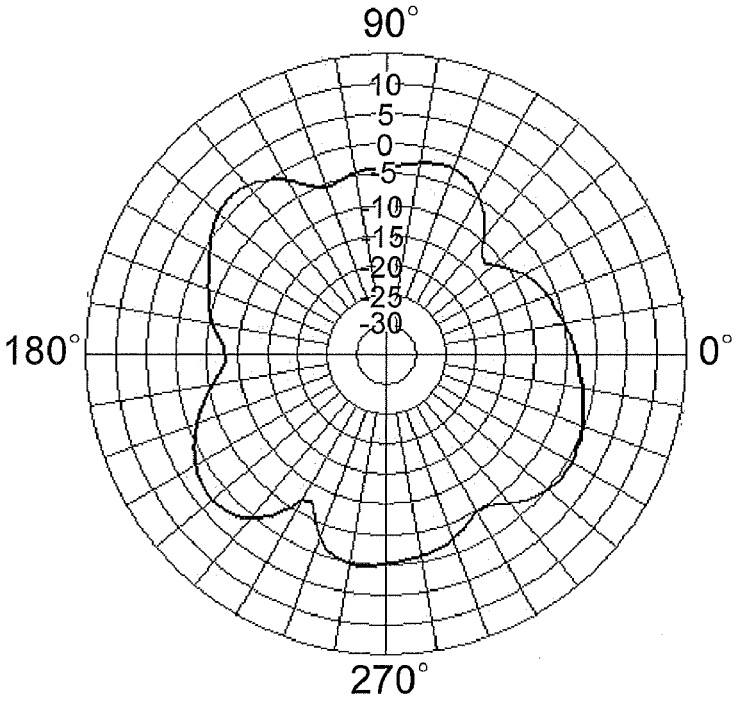
FIG. 25 shows a VSWR measurement chart of antenna 130 being in the first placement state and operated at 5.45 GHz.
Figure 26:
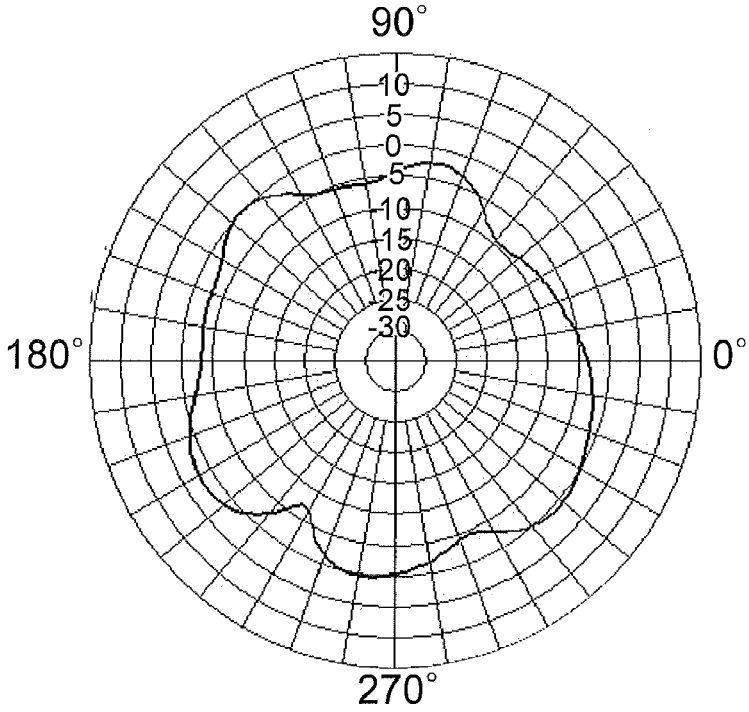
FIG. 26 shows a VSWR measurement chart of antenna 130 being in the first placement state and operated at 5.75 GHz.
Figure 27:
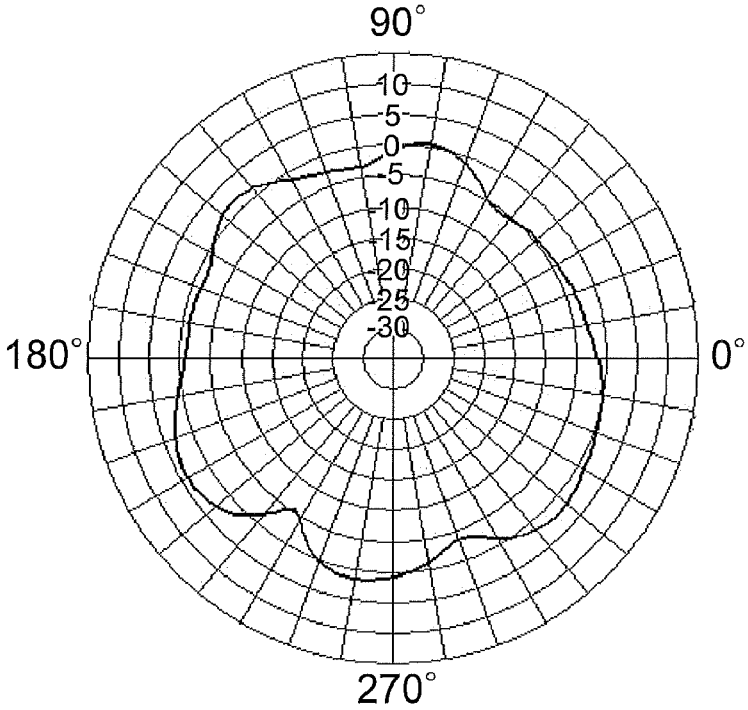
FIG. 27 shows a VSWR measurement chart of antenna 130 being in the first placement state and operated at 5.85 GHz.
Figure 69:
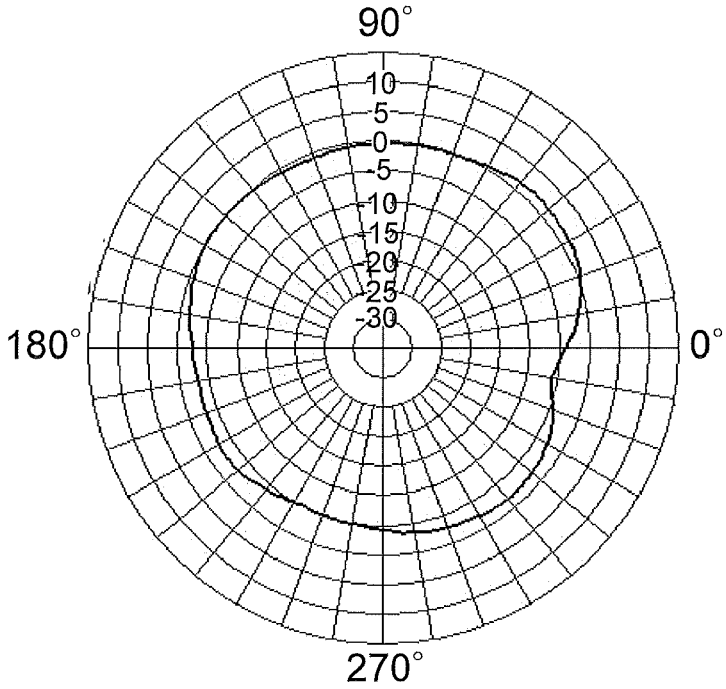
FIG. 69 shows a VSWR measurement chart of antenna 130 being in the third placement state and operated at 5.85 GHz.

Referring to both FIG. 5 to FIG. 69. FIG. 5 shows a VSWR measurement chart of antenna 120. FIG. 6 shows a VSWR measurement chart of antenna 130. FIG. 7 shows a dual-band dual-antenna structure being in the first placement state. FIG. 8 shows a VSWR measurement chart of antenna 120 being in the first placement state and operated at 2.4 GHz. FIG. 9 shows a VSWR measurement chart of antenna 120 being in the first placement state and operated at 2.45 GHz. FIG. 10 shows a VSWR measurement chart of antenna 120 being in the first placement state and operated at 2.5 GHz. FIG. 11 shows a VSWR measurement chart of antenna 120 being in the first placement state and operated at 4.9 GHz. FIG. 12 shows a VSWR measurement chart of antenna 120 being in the first placement state and operated at 5.15 GHz. FIG. 13 shows a VSWR measurement chart of antenna 120 being in the first placement state and operated at 5.25 GHz. FIG. 14 shows a VSWR measurement chart of antenna 120 being in the first placement state and operated at 5.35 GHz. FIG. 15 shows a VSWR measurement chart of antenna 120 being in the first placement state and operated at 5.45 GHz. FIG. 16 shows a VSWR measurement chart of antenna 120 being in the first placement state and operated at 5.75 GHz. FIG. 17 shows a VSWR measurement chart of antenna 120 being in the first placement state and operated at 5.85 GHz. FIG. 18 shows a VSWR measurement chart of antenna 130 being in the first placement state and operated at 2.4 GHz. FIG. 19 shows a VSWR measurement chart of antenna 130 being in the first placement state and operated at 2.45 GHz. FIG. 20 shows a VSWR measurement chart of antenna 130 being in the first placement state and operated at 2.5 GHz. FIG. 21 shows a VSWR measurement chart of antenna 130 being in the first placement state and operated at 4.9 GHz. FIG. 22 shows a VSWR measurement chart of antenna 130 being in the first placement state and operated at 5.15 GHz. FIG. 23 shows a VSWR measurement chart of antenna 130 being in the first placement state and operated at 5.25 GHz. FIG. 24 shows a VSWR measurement chart of antenna 130 being in the first placement state and operated at 5.35 GHz. FIG. 25 shows a VSWR measurement chart of antenna 130 being in the first placement state and operated at 5.45 GHz. FIG. 26 shows a VSWR measurement chart of antenna 130 being in the first placement state and operated at 5.75 GHz. FIG. 27 shows a VSWR measurement chart of antenna 130 being in the first placement state and operated at 5.85 GHz.

Figure 28:
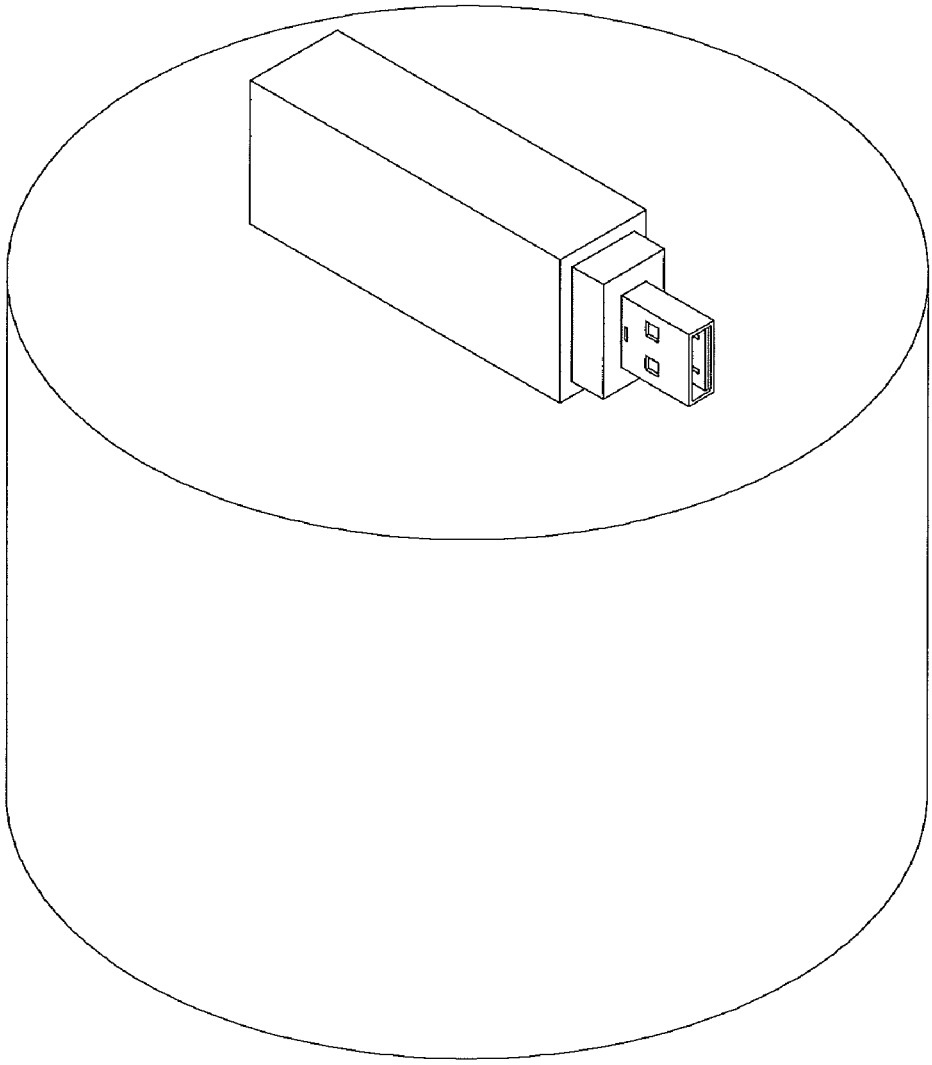
FIG. 28 shows a dual-band dual-antenna structure being in the second placement state.
Figure 29:
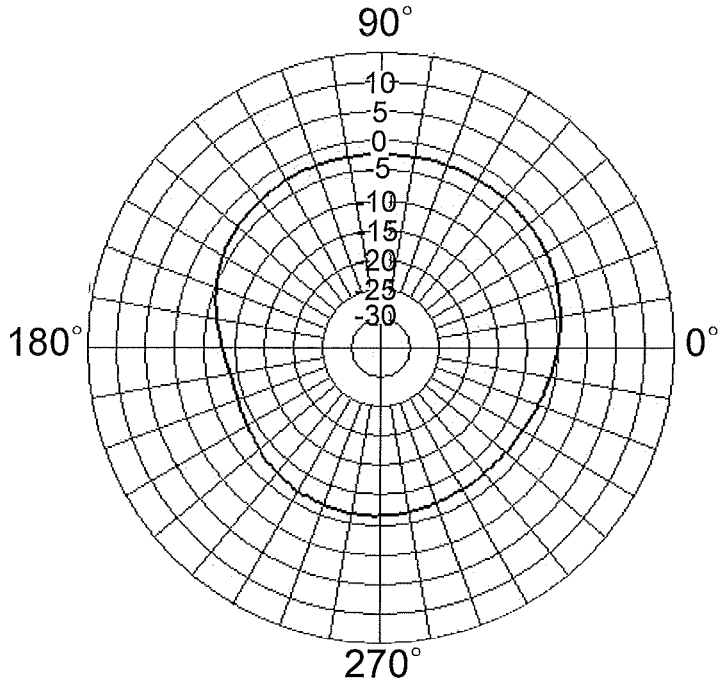
FIG. 29 shows a VSWR measurement chart of antenna 120 being in the second placement state and operated at 2.4 GHz.
Figure 30:
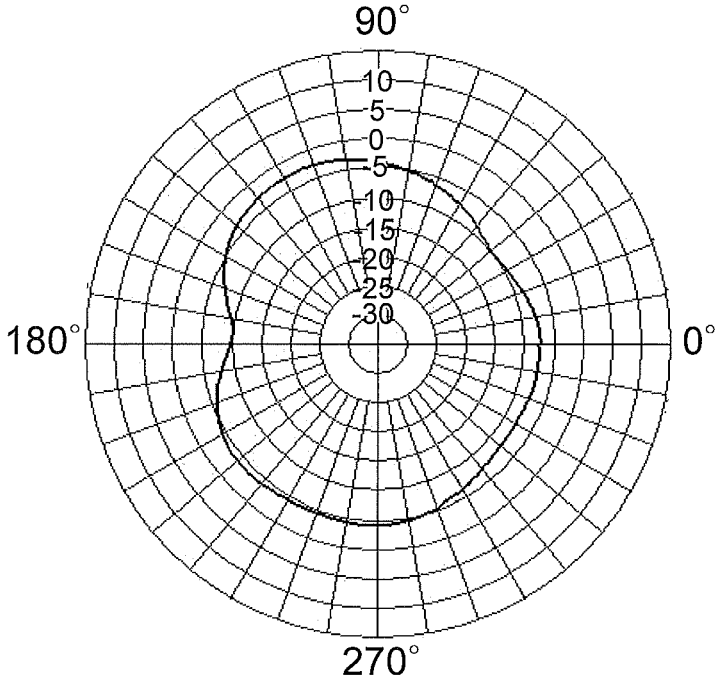
FIG. 30 shows a VSWR measurement chart of antenna 120 being in the second placement state and operated at 2.45 GHz.
Figure 31:
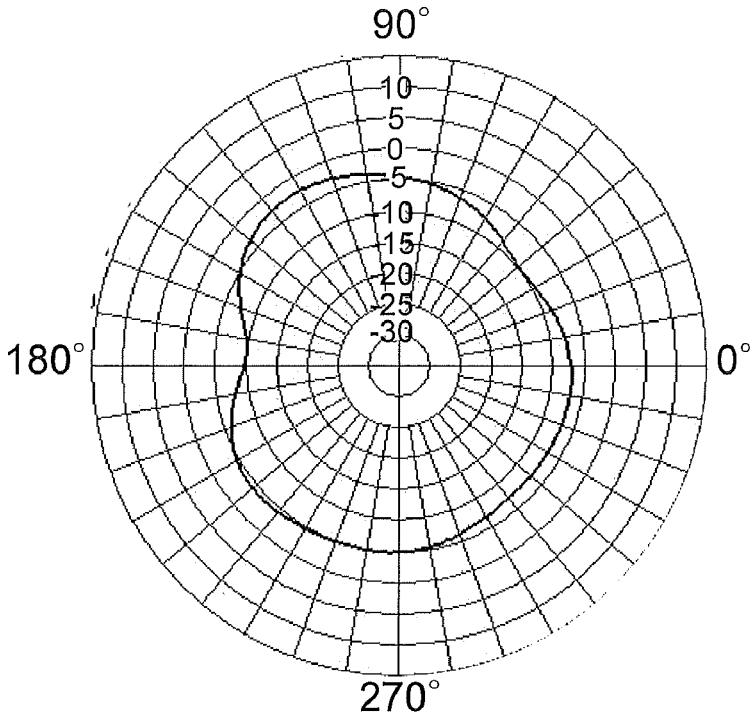
FIG. 31 shows a VSWR measurement chart of antenna 120 being in the second placement state and operated at 2.5 GHz.
Figure 32:
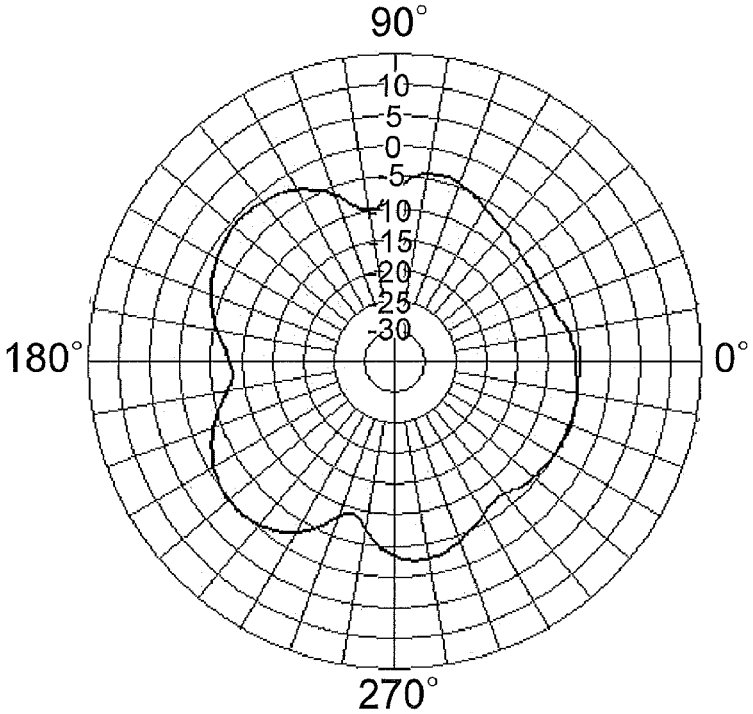
FIG. 32 shows a VSWR measurement chart of antenna 120 being in the second placement state and operated at 4.9 GHz.
Figure 33:
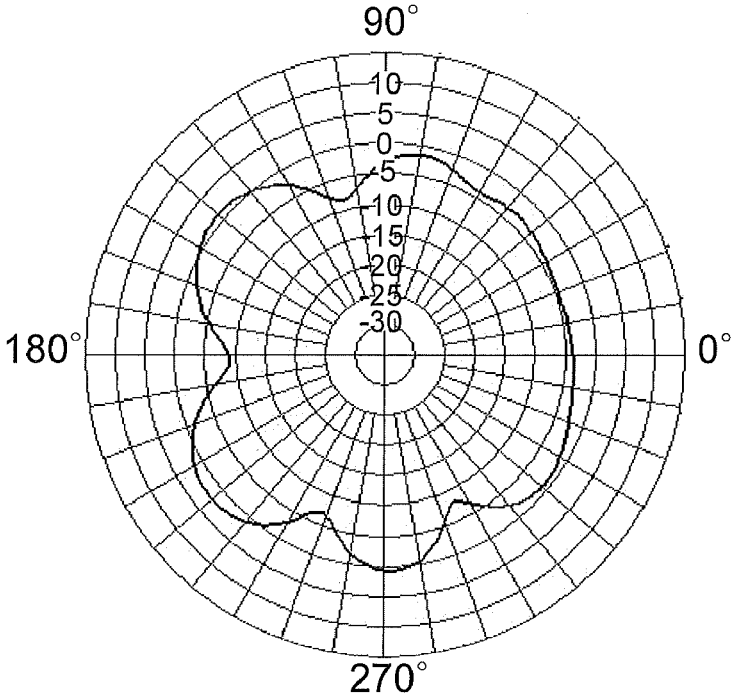
FIG. 33 shows a VSWR measurement chart of antenna 120 being in the second placement state and operated at 5.15 GHz.
Figure 34:
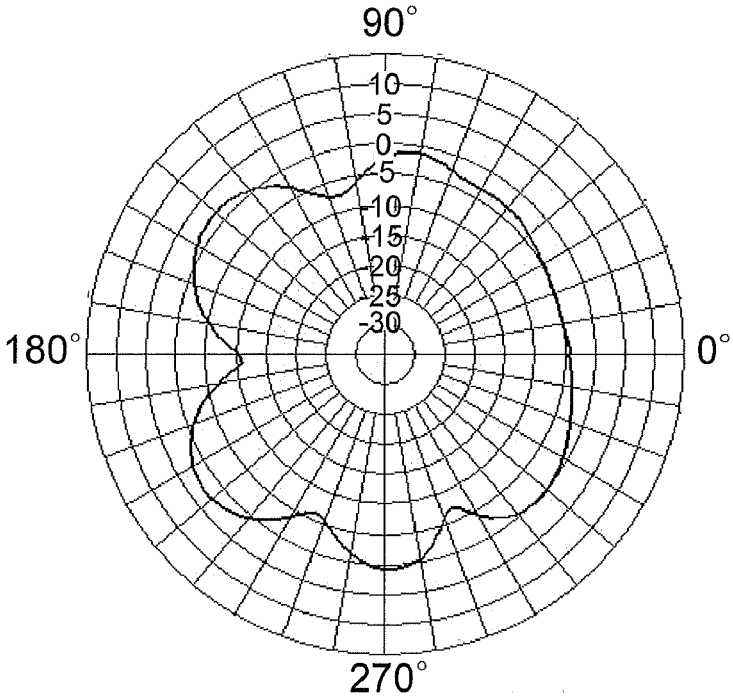
FIG. 34 shows a VSWR measurement chart of antenna 120 being in the second placement state and operated at 5.25 GHz.
Figure 35:
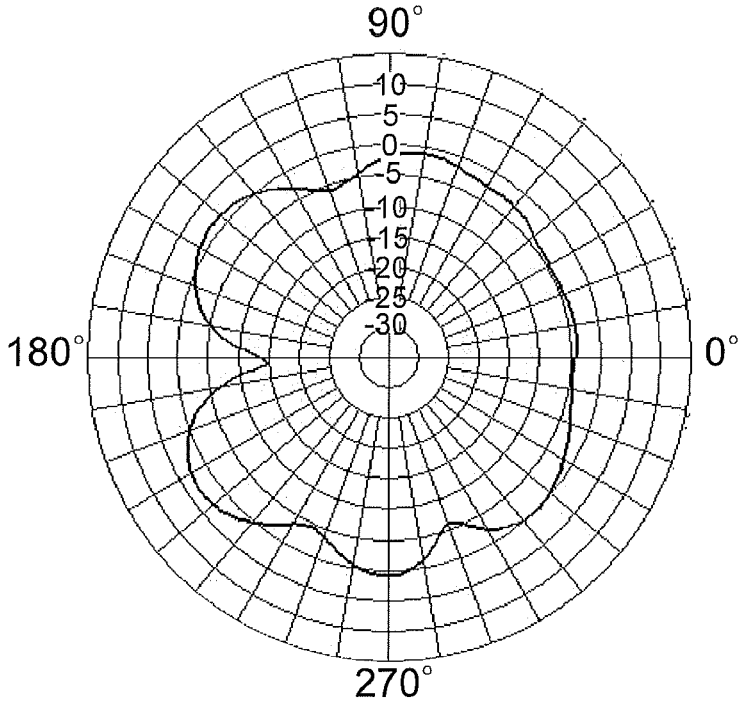
FIG. 35 shows a VSWR measurement chart of antenna 120 being in the second placement state and operated at 5.35 GHz.
Figure 36:
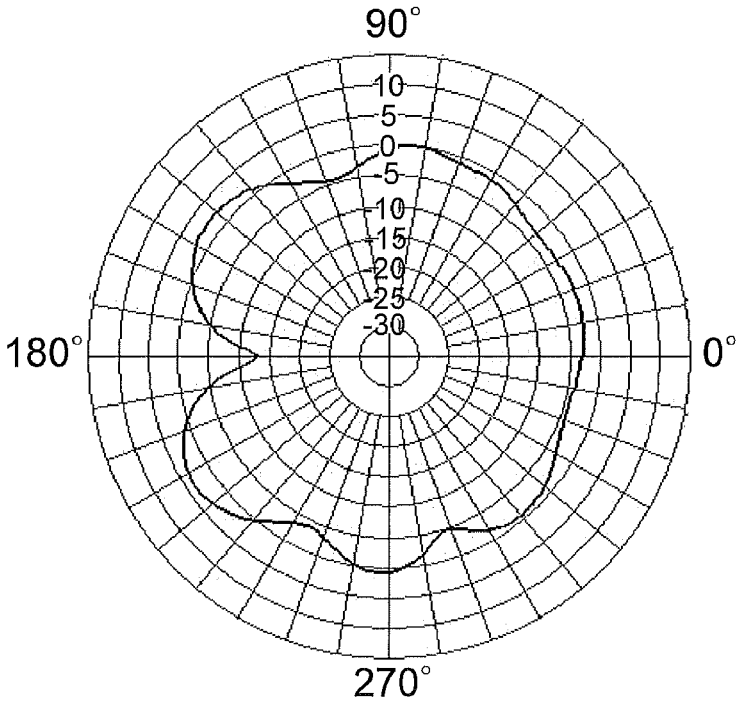
FIG. 36 shows a VSWR measurement chart of antenna 120 being in the second placement state and operated at 5.45 GHz.
Figure 37:
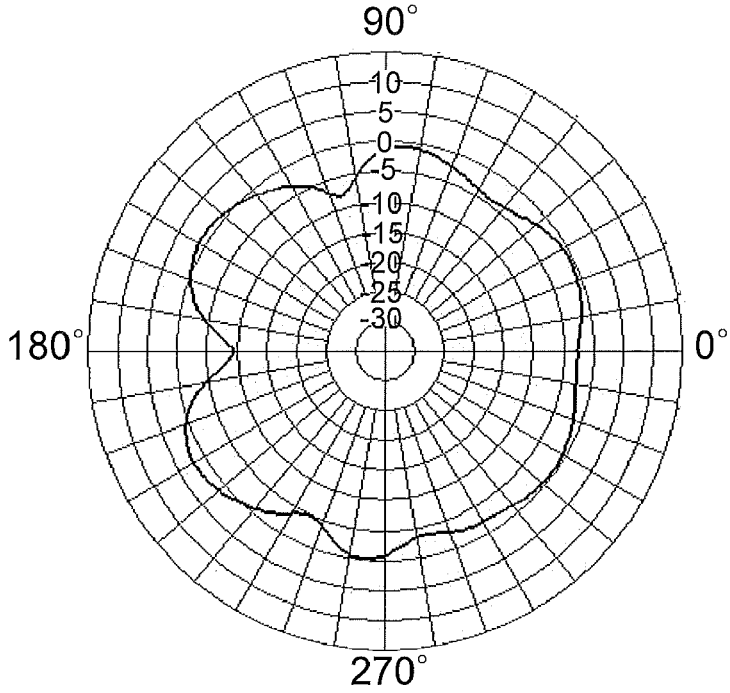
FIG. 37 shows a VSWR measurement chart of antenna 120 being in the second placement state and operated at 5.75 GHz.
Figure 38:
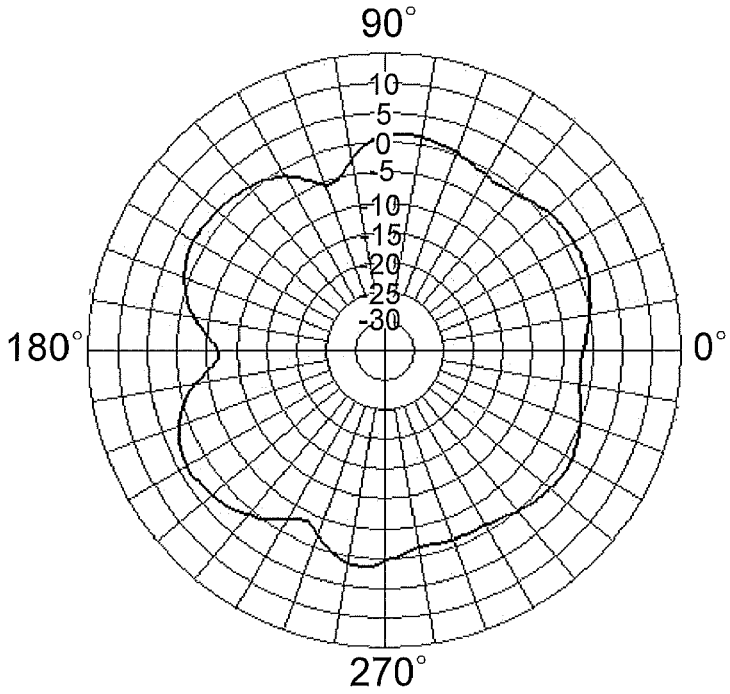
FIG. 38 shows a VSWR measurement chart of antenna 120 being in the second placement state and operated at 5.85 GHz.
Figure 39:
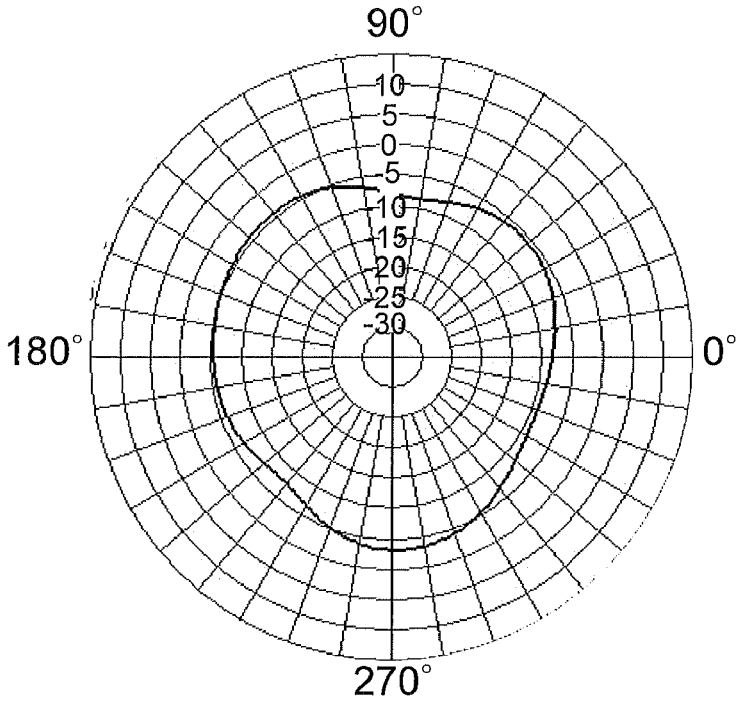
FIG. 39 shows a VSWR measurement chart of antenna 130 being in the second placement state and operated at 2.4 GHz.
Figure 40:
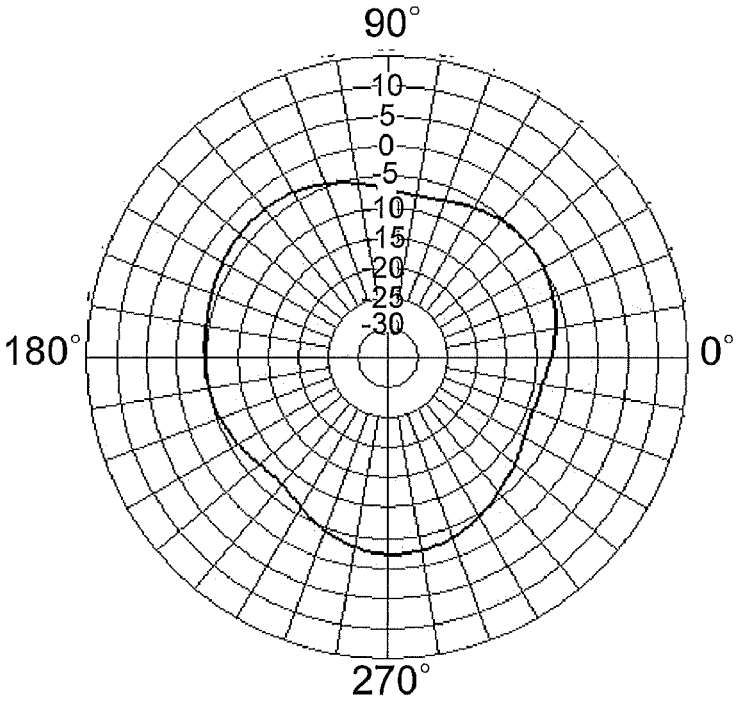
FIG. 40 shows a VSWR measurement chart of antenna 130 being in the second placement state and operated at 2.45 GHz.
Figure 41:
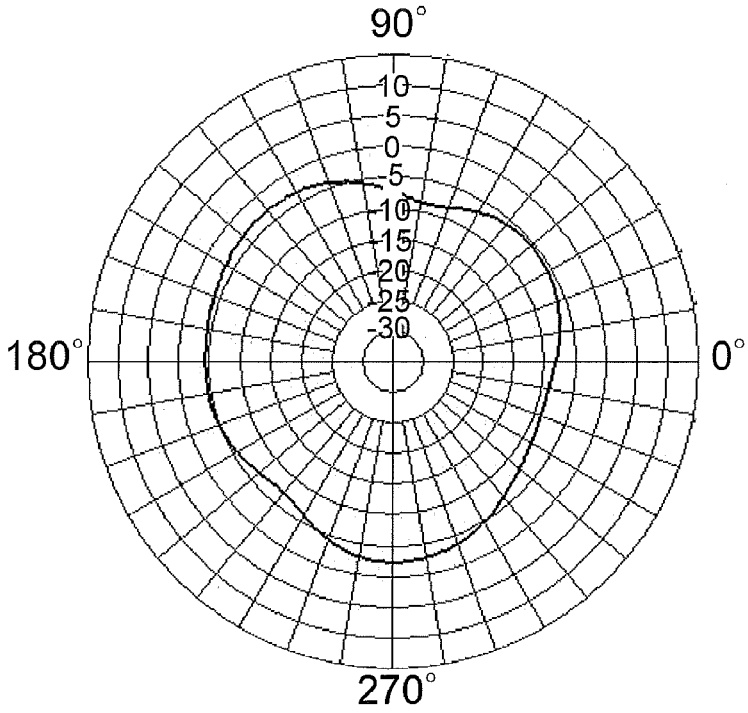
FIG. 41 shows a VSWR measurement chart of antenna 130 being in the second placement state and operated at 2.5 GHz.
Figure 42:
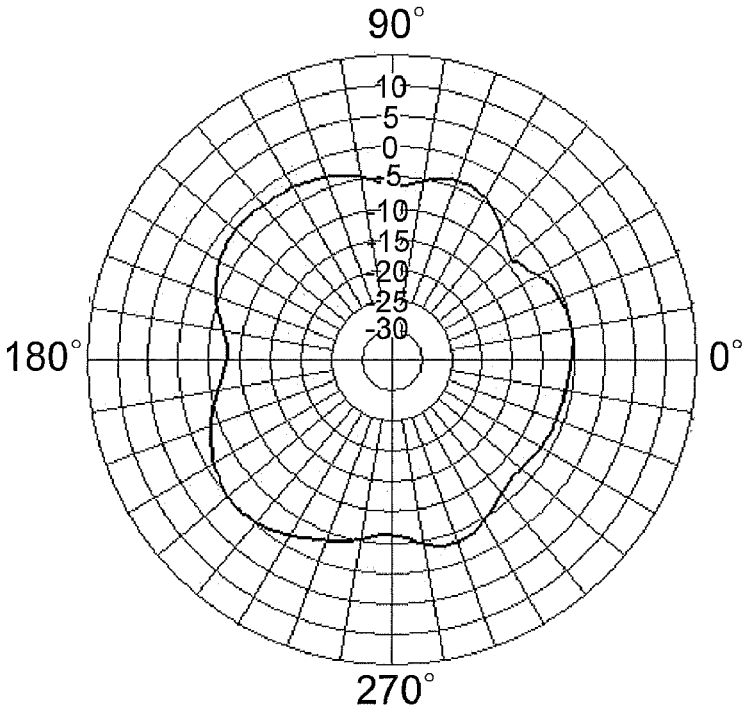
FIG. 42 shows a VSWR measurement chart of antenna 130 being in the second placement state and operated at 4.9 GHz.
Figure 43:
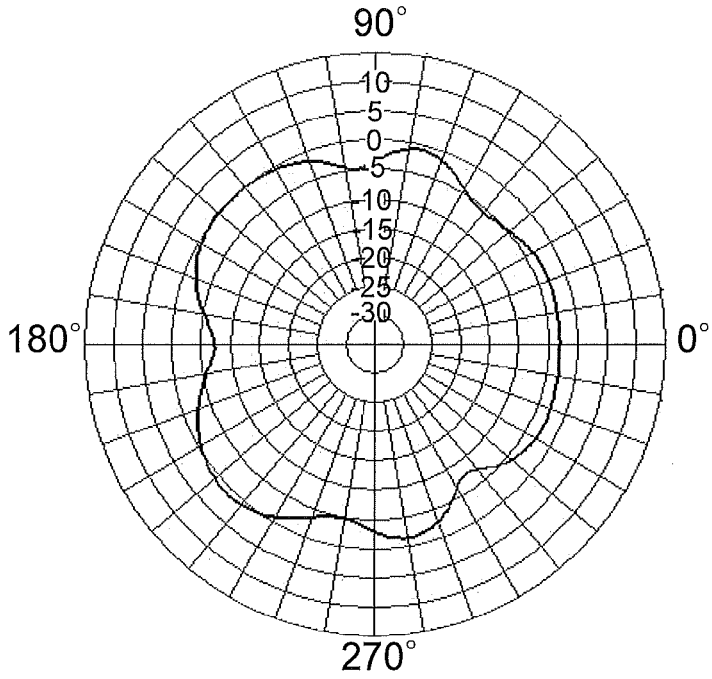
FIG. 43 shows a VSWR measurement chart of antenna 130 being in the second placement state and operated at 5.15 GHz.
Figure 44:
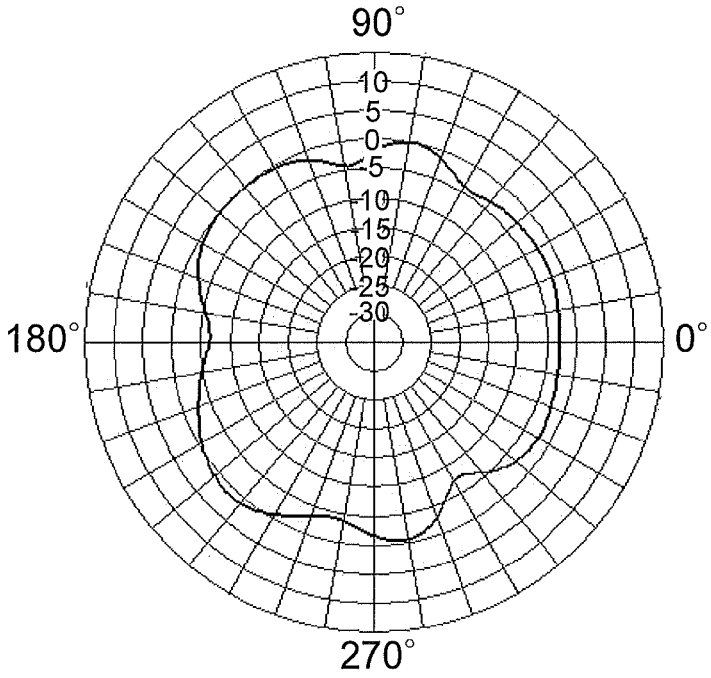
FIG. 44 shows a VSWR measurement chart of antenna 130 being in the second placement state and operated at 5.25 GHz.
Figure 45:
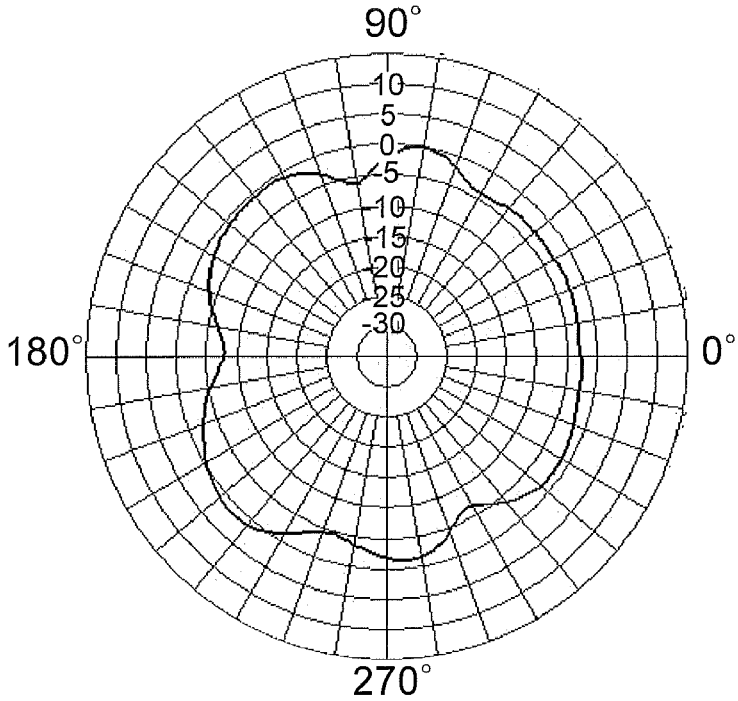
FIG. 45 shows a VSWR measurement chart of antenna 130 being in the second placement state and operated at 5.35 GHz.
Figure 46:
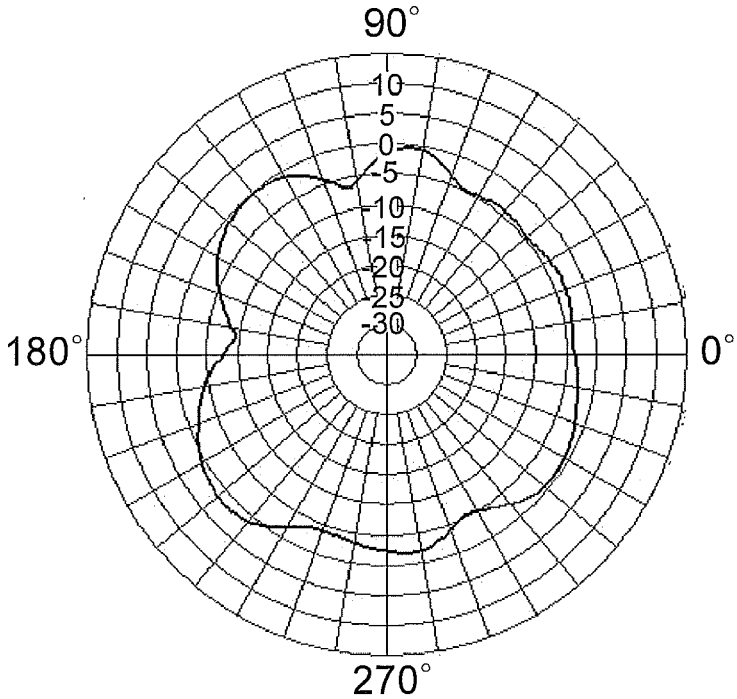
FIG. 46 shows a VSWR measurement chart of antenna 130 being in the second placement state and operated at 5.45 GHz.
Figure 47:
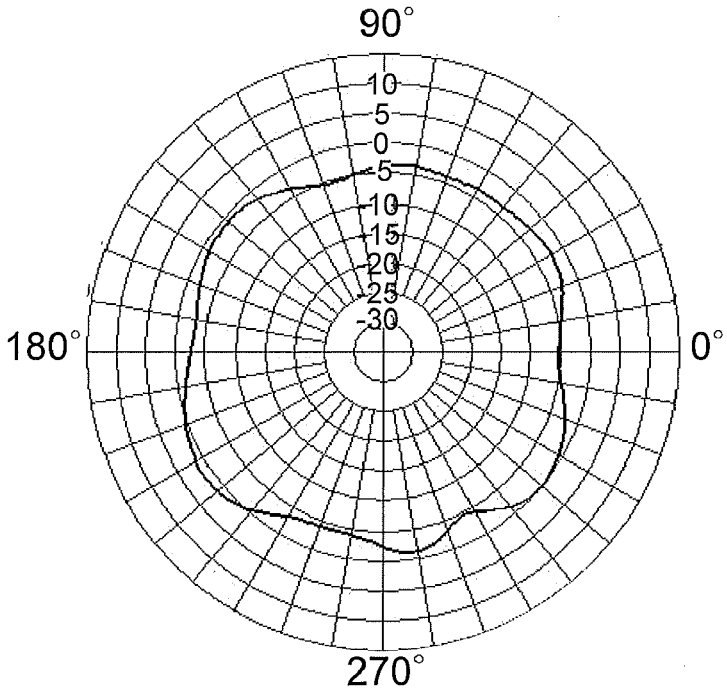
FIG. 47 shows a VSWR measurement chart of antenna 130 being in the second placement state and operated at 5.75 GHz.
Figure 48:
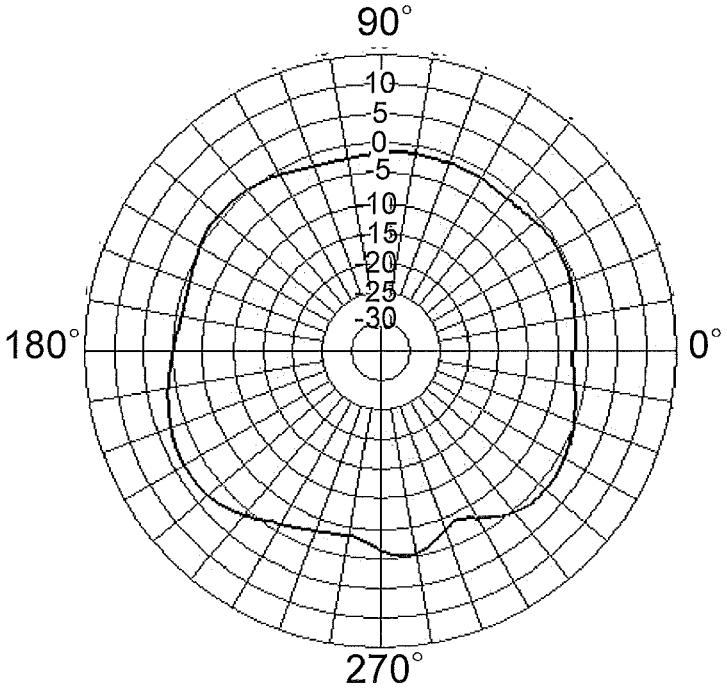
FIG. 48 shows a VSWR measurement chart of antenna 130 being in the second placement state and operated at 5.85 GHz.

FIG. 28 shows a dual-band dual-antenna structure being in the second placement state. FIG. 29 shows a VSWR measurement chart of antenna 120 being in the second placement state and operated at 2.4 GHz. FIG. 30 shows a VSWR measurement chart of antenna 120 being in the second placement state and operated at 2.45 GHz. FIG. 31 shows a VSWR measurement chart of antenna 120 being in the second placement state and operated at 2.5 GHz. FIG. 32 shows a VSWR measurement chart of antenna 120 being in the second placement state and operated at 4.9 GHz. FIG. 33 shows a VSWR measurement chart of antenna 120 being in the second placement state and operated at 5.15 GHz. FIG. 34 shows a VSWR measurement chart of antenna 120 being in the second placement state and operated at 5.25 GHz. FIG. 35 shows a VSWR measurement chart of antenna 120 being in the second placement state and operated at 5.35 GHz. FIG. 36 shows a VSWR measurement chart of antenna 120 being in the second placement state and operated at 5.45 GHz. FIG. 37 shows a VSWR measurement chart of antenna 120 being in the second placement state and operated at 5.75 GHz. FIG. 38 shows a VSWR measurement chart of antenna 120 being in the second placement state and operated at 5.85 GHz. FIG. 39 shows a VSWR measurement chart of antenna 130 being in the second placement state and operated at 2.4 GHz. FIG. 40 shows a VSWR measurement chart of antenna 130 being in the second placement state and operated at 2.45 GHz. FIG. 41 shows a VSWR measurement chart of antenna 130 being in the second placement state and operated at 2.5 GHz. FIG. 42 shows a VSWR measurement chart of antenna 130 being in the second placement state and operated at 4.9 GHz. FIG. 43 shows a VSWR measurement chart of antenna 130 being in the second placement state and operated at 5.15 GHz. FIG. 44 shows a VSWR measurement chart of antenna 130 being in the second placement state and operated at 5.25 GHz. FIG. 45 shows a VSWR measurement chart of antenna 130 being in the second placement state and operated at 5.35 GHz. FIG. 46 shows a VSWR measurement chart of antenna 130 being in the second placement state and operated at 5.45 GHz. FIG. 47 shows a VSWR measurement chart of antenna 130 being in the second placement state and operated at 5.75 GHz. FIG. 48 shows a VSWR measurement chart of antenna 130 being in the second placement state and operated at 5.85 GHz.

Figure 49:
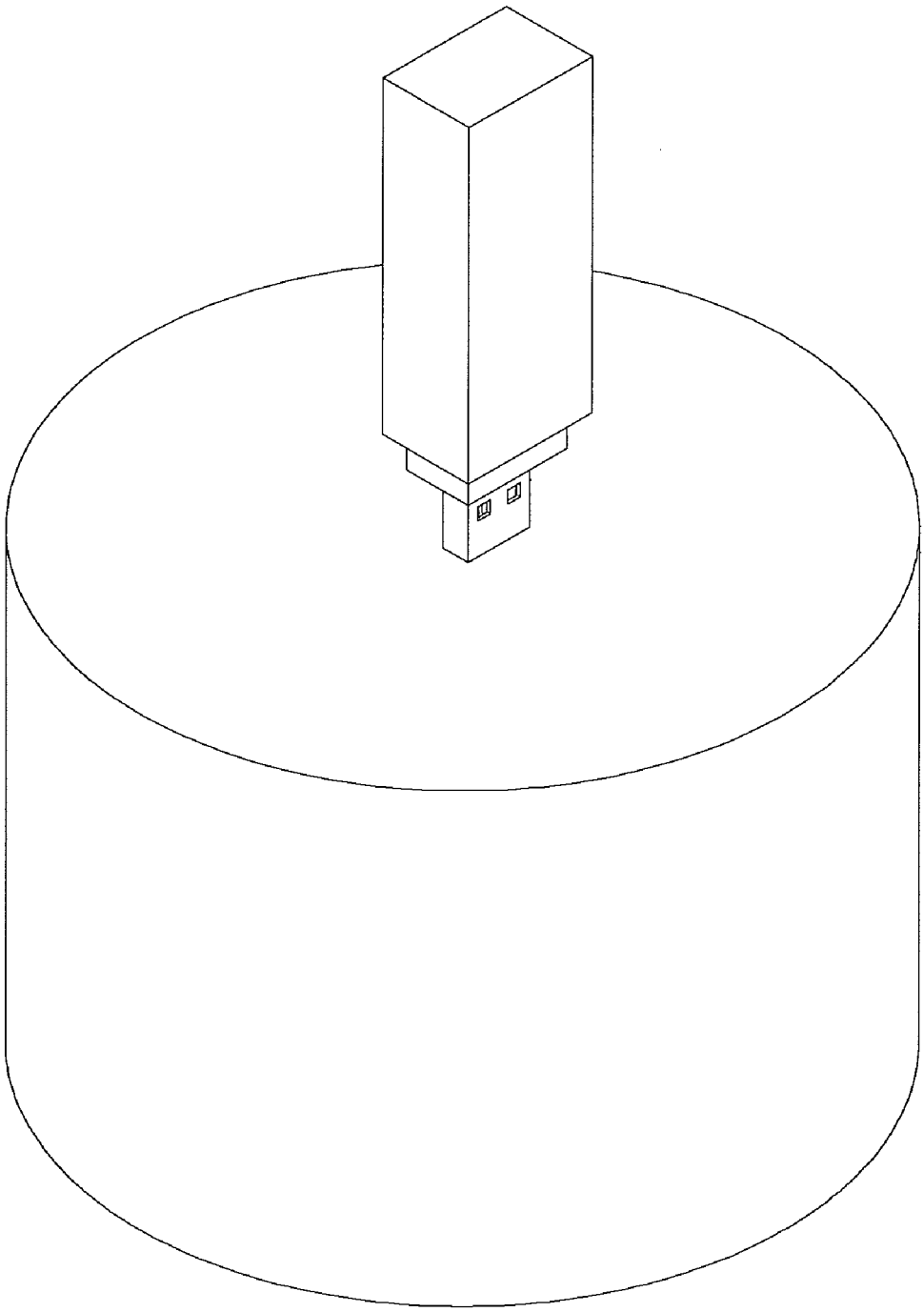
FIG. 49 shows a dual-band dual-antenna structure being in the third placement state.
Figure 50:
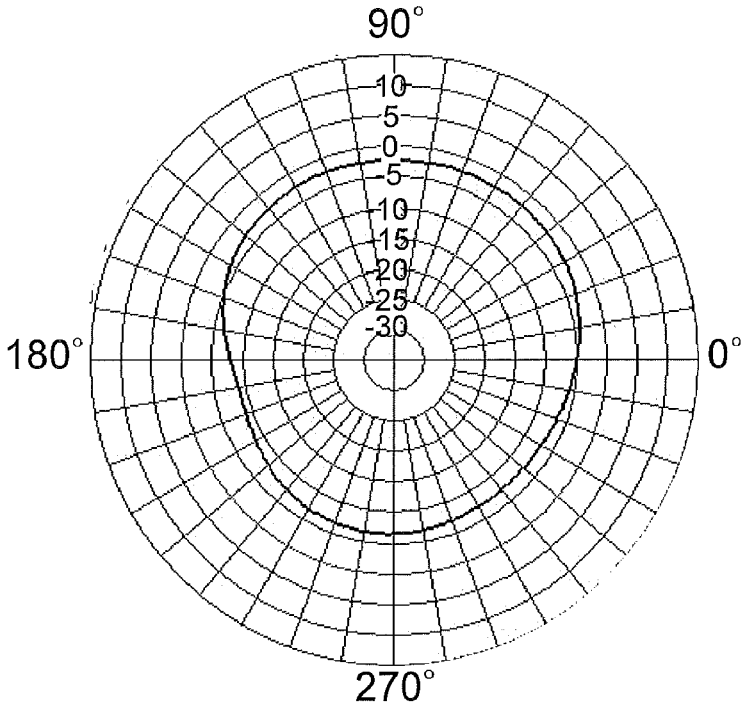
FIG. 50 shows a VSWR measurement chart of antenna 120 being in the third placement state and operated at 2.4 GHz.
Figure 51:
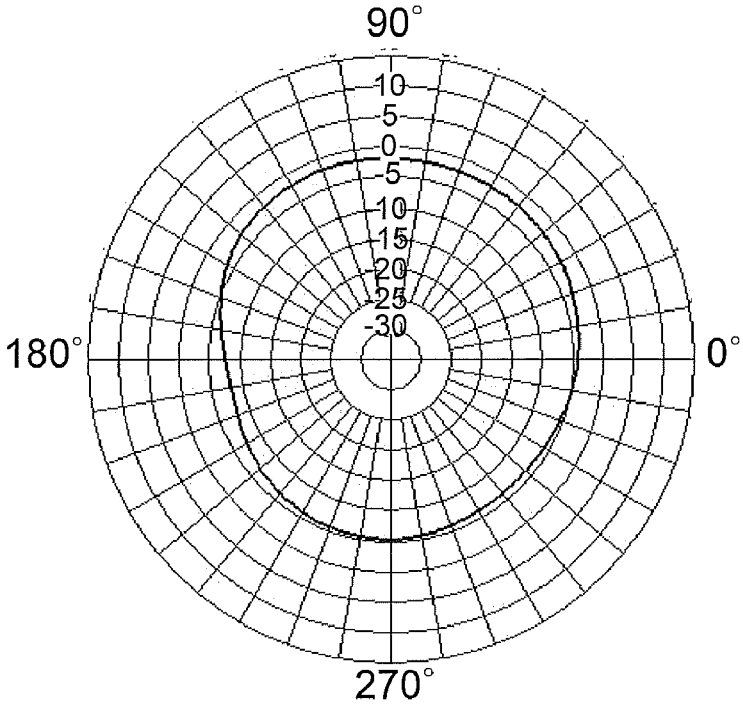
FIG. 51 shows a VSWR measurement chart of antenna 120 being in the third placement state and operated at 2.45 GHz.
Figure 52:
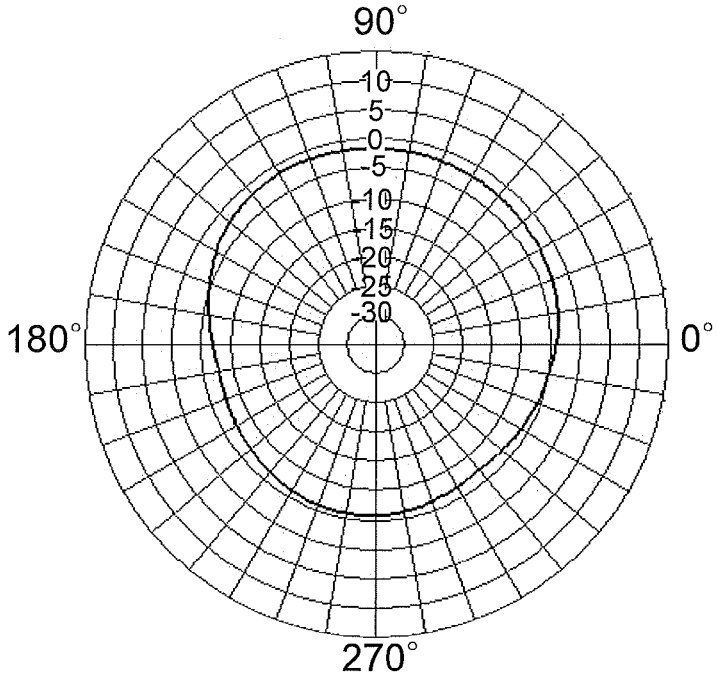
FIG. 52 shows a VSWR measurement chart of antenna 120 being in the third placement state and operated at 2.5 GHz.
Figure 53:
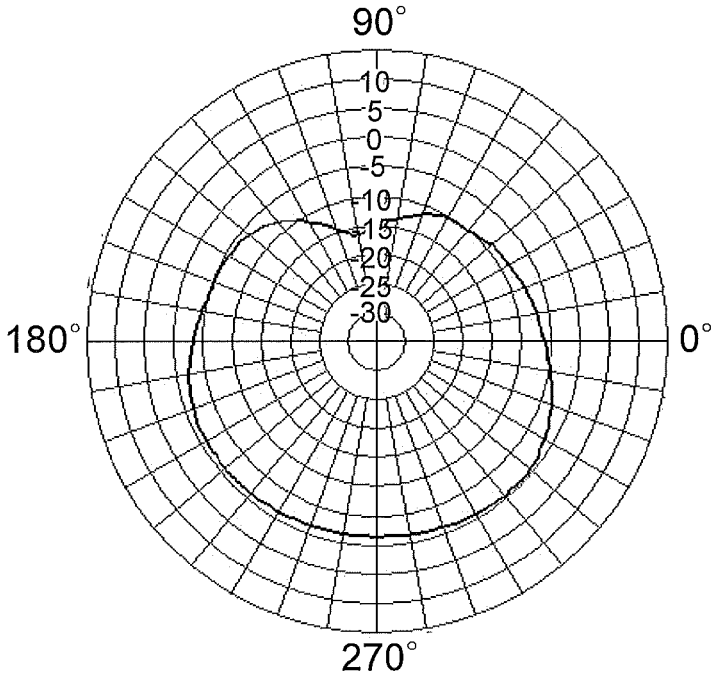
FIG. 53 shows a VSWR measurement chart of antenna 120 being in the third placement state and operated at 4.9 GHz.
Figure 54:
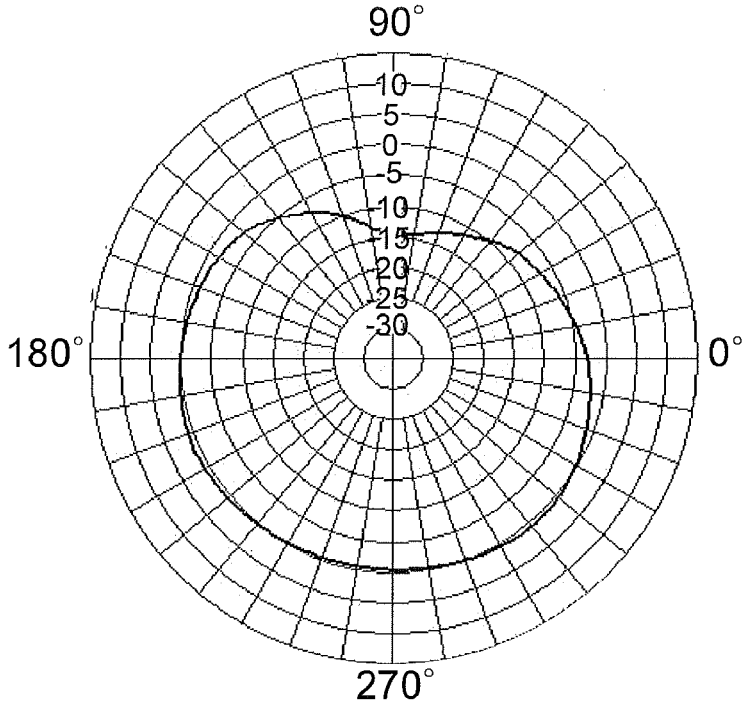
FIG. 54 shows a VSWR measurement chart of antenna 120 being in the third placement state and operated at 5.15 GHz.
Figure 55:
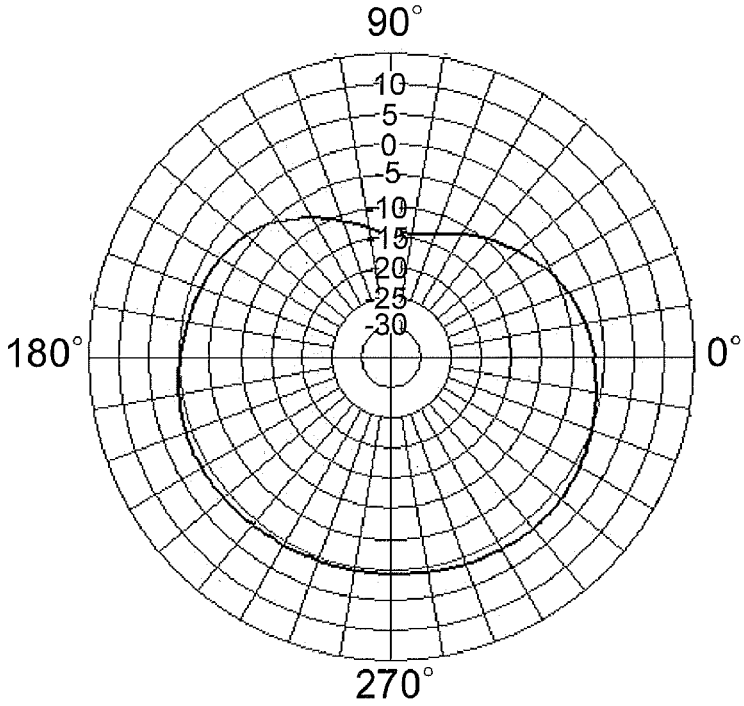
FIG. 55 shows a VSWR measurement chart of antenna 120 being in the third placement state and operated at 5.25 GHz.
Figure 56:
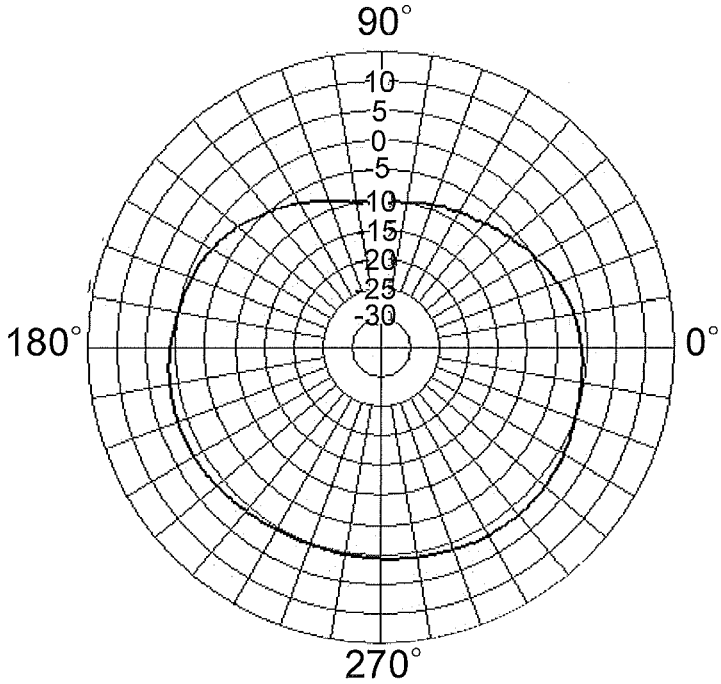
FIG. 56 shows a VSWR measurement chart of antenna 120 being in the third placement state and operated at 5.35 GHz.
Figure 57:
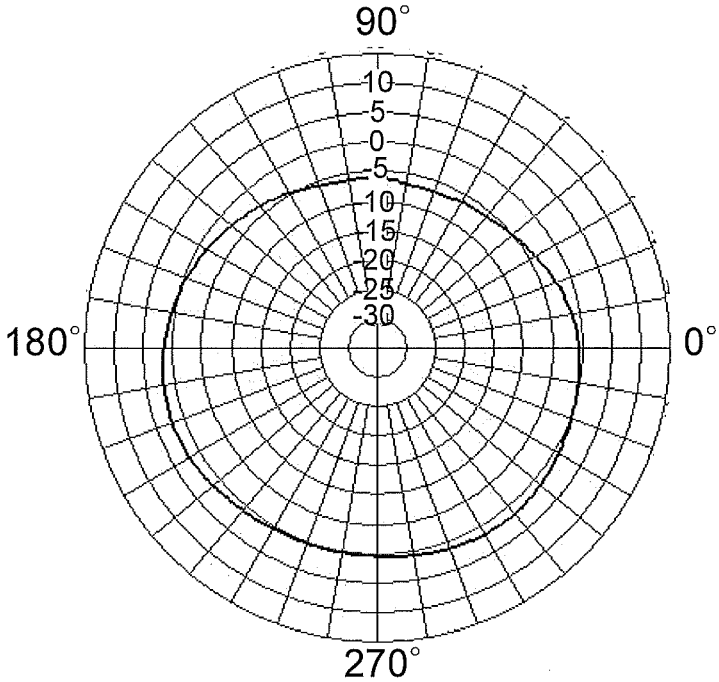
FIG. 57 shows a VSWR measurement chart of antenna 120 being in the third placement state and operated at 5.45 GHz.
Figure 58:
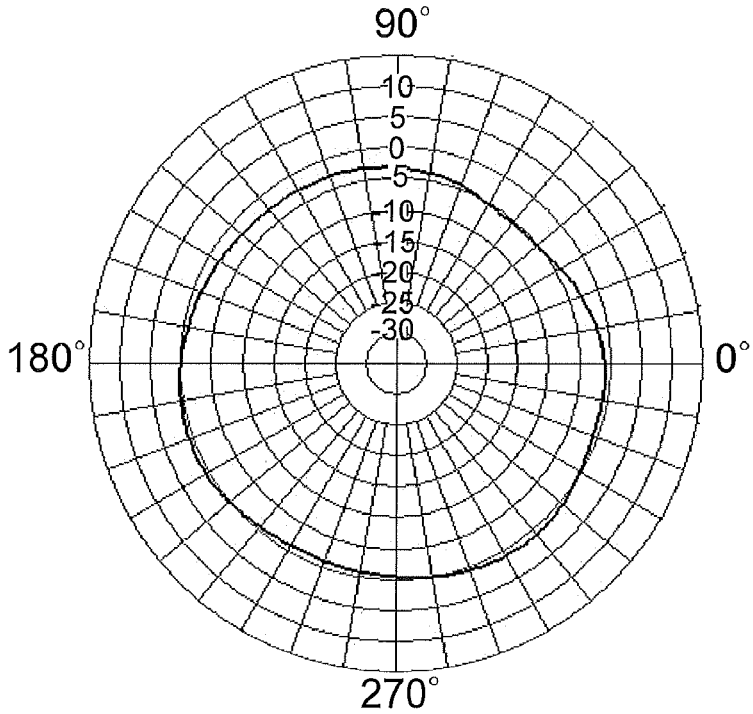
FIG. 58 shows a VSWR measurement chart of antenna 120 being in the third placement state and operated at 5.75 GHz.
Figure 59:
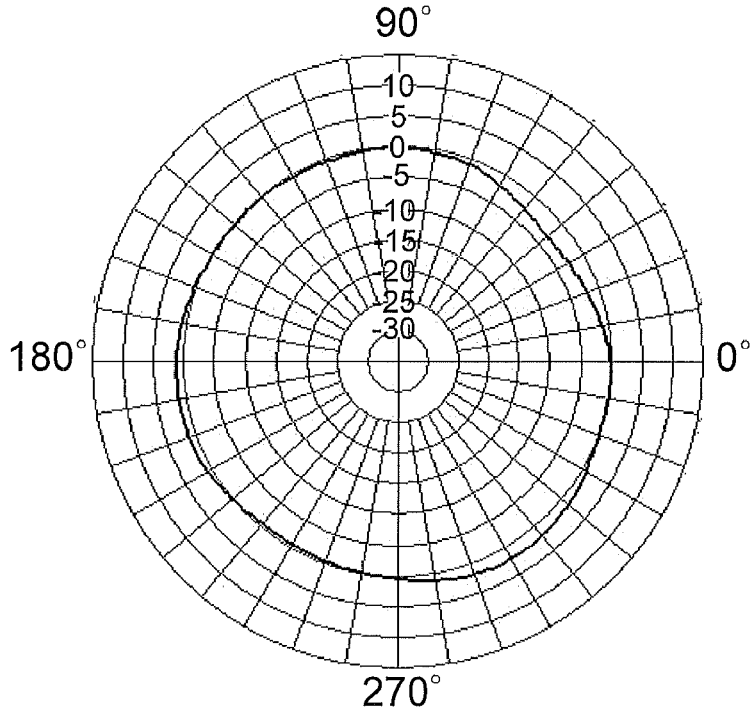
FIG. 59 shows a VSWR measurement chart of antenna 120 being in the third placement state and operated at 5.85 GHz.
Figure 60:
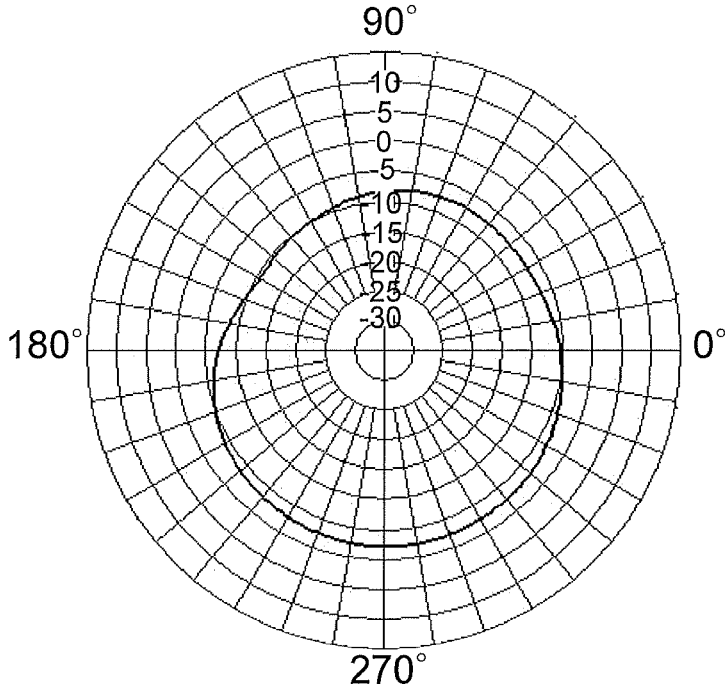
FIG. 60 shows a VSWR measurement chart of antenna 130 being in the third placement state and operated at 2.4 GHz.
Figure 61:
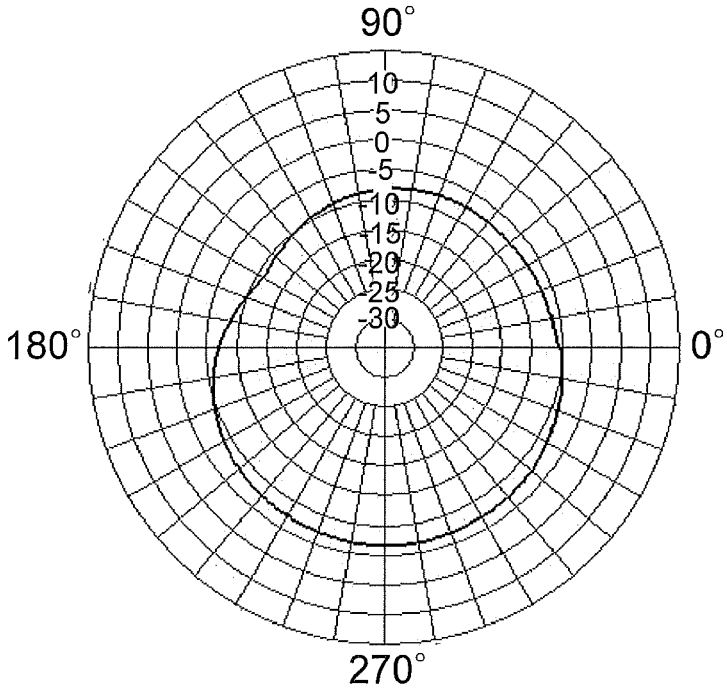
FIG. 61 shows a VSWR measurement chart of antenna 130 being in the third placement state and operated at 2.45 GHz.
Figure 62:
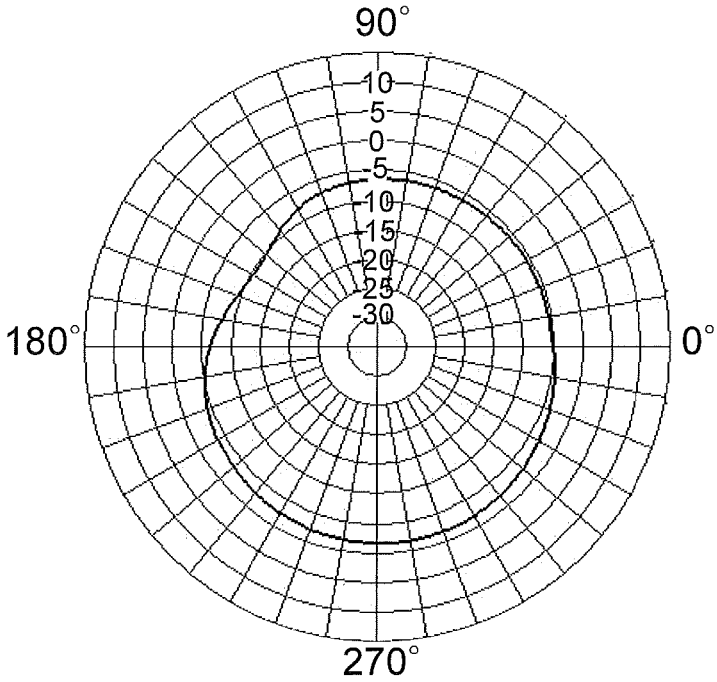
FIG. 62 shows a VSWR measurement chart of antenna 130 being in the third placement state and operated at 2.5 GHz.
Figure 63:
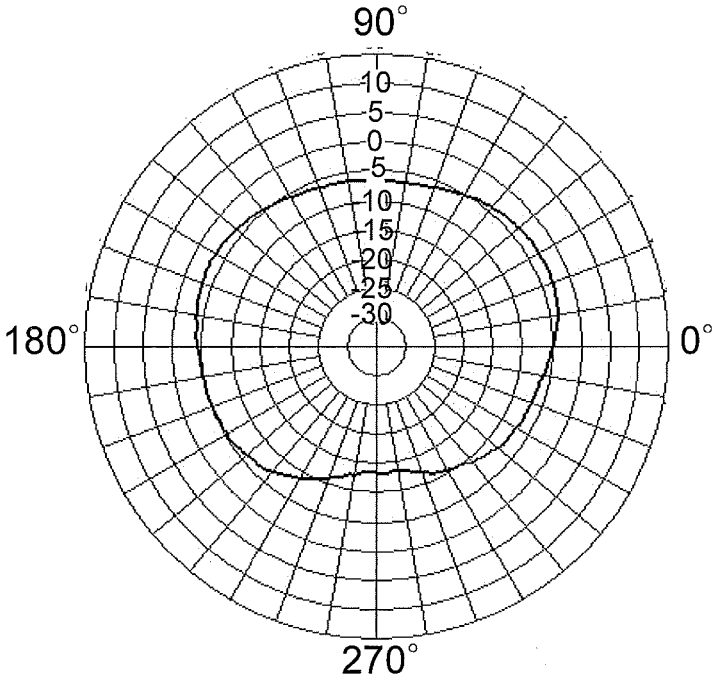
FIG. 63 shows a VSWR measurement chart of antenna 130 being in the third placement state and operated at 4.9 GHz.
Figure 64:
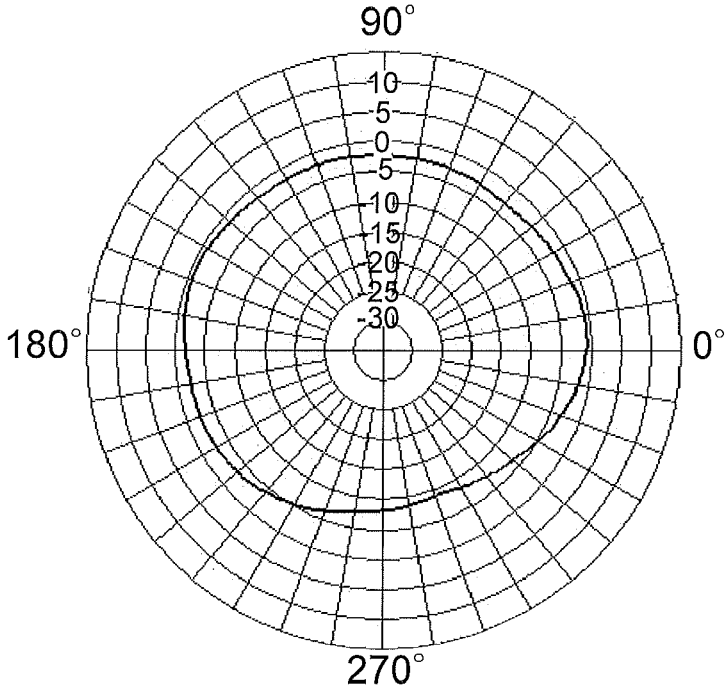
FIG. 64 shows a VSWR measurement chart of antenna 130 being in the third placement state and operated at 5.15 GHz.
Figure 65:
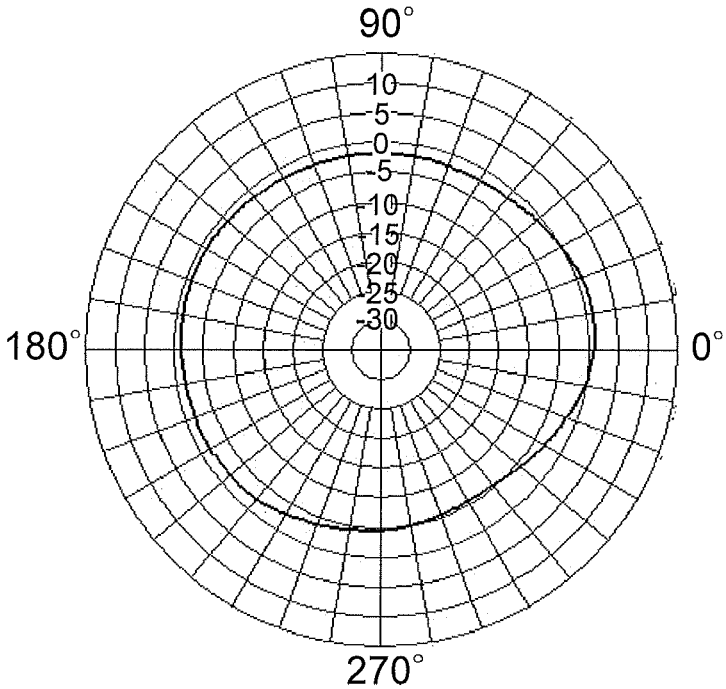
FIG. 65 shows a VSWR measurement chart of antenna 130 being in the third placement state and operated at 5.25 GHz.
Figure 66:
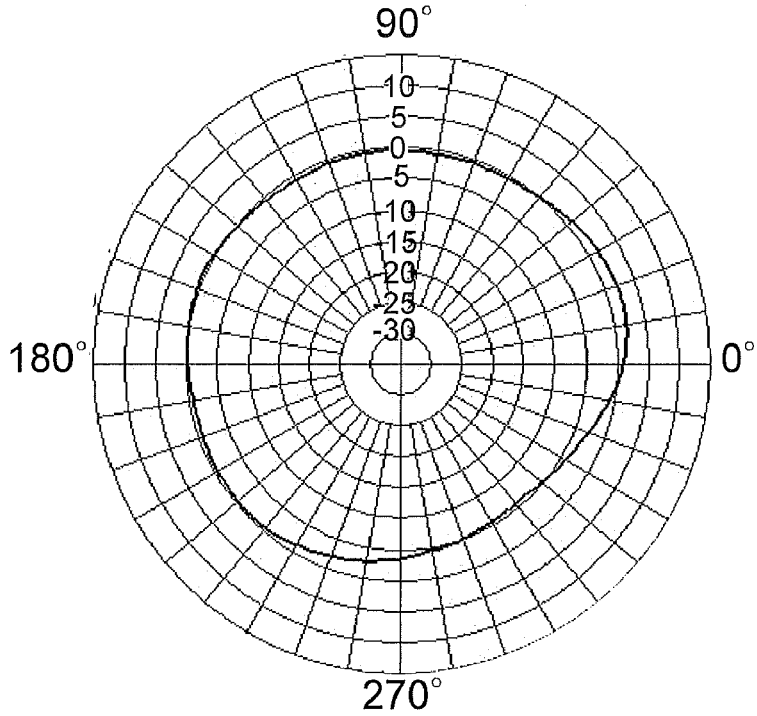
FIG. 66 shows a VSWR measurement chart of antenna 130 being in the third placement state and operated at 5.35 GHz.
Figure 67:
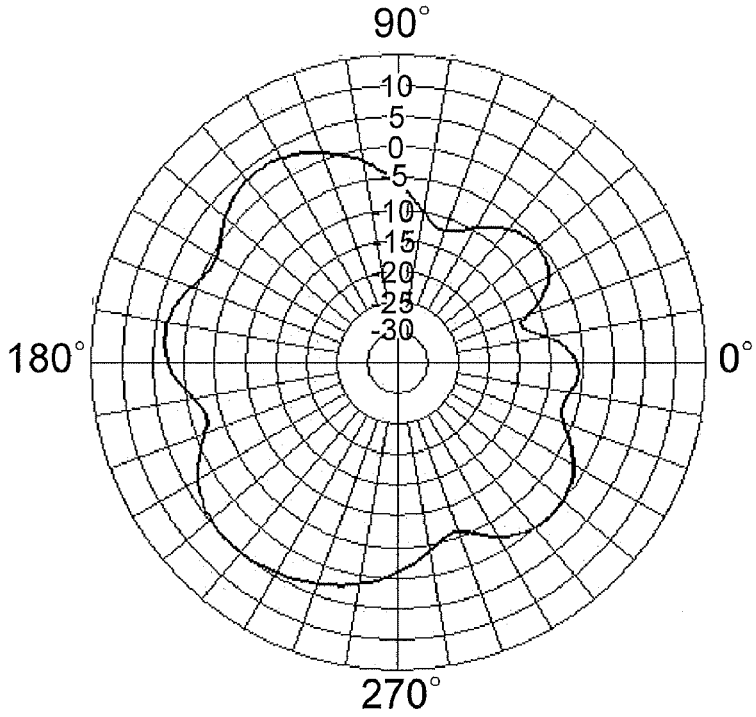
FIG. 67 shows a VSWR measurement chart of antenna 130 being in the third placement state and operated at 5.45 GHz.
Figure 68:
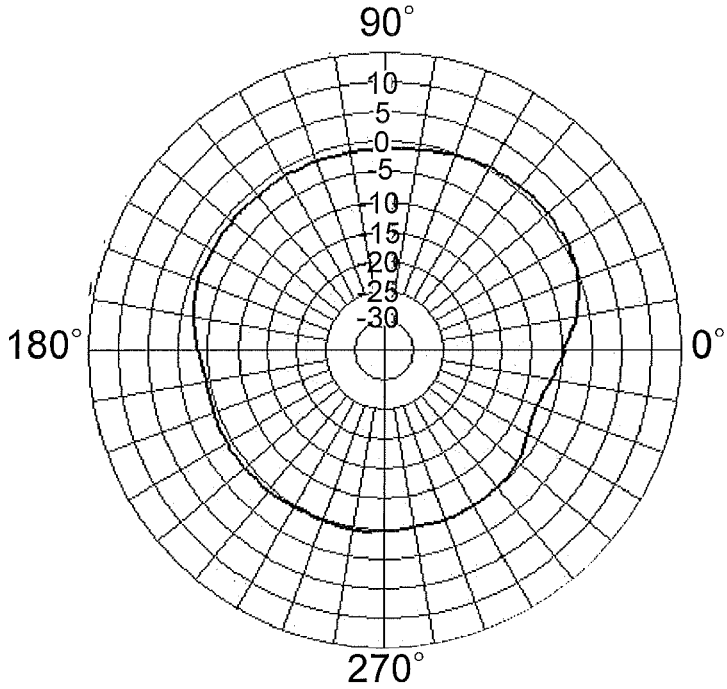
FIG. 68 shows a VSWR measurement chart of antenna 130 being in the third placement state and operated at 5.75 GHz.

FIG. 49 shows a dual-band dual-antenna structure being in the third placement state. FIG. 50 shows a VSWR measurement chart of antenna 120 being in the third placement state and operated at 2.4 GHz. FIG. 51 shows a VSWR measurement chart of antenna 120 being in the third placement state and operated at 2.45 GHz. FIG. 52 shows a VSWR measurement chart of antenna 120 being in the third placement state and operated at 2.5 GHz. FIG. 53 shows a VSWR measurement chart of antenna 120 being in the third placement state and operated at 4.9 GHz. FIG. 54 shows a VSWR measurement chart of antenna 120 being in the third placement state and operated at 5.15 GHz. FIG. 55 shows a VSWR measurement chart of antenna 120 being in the third placement state and operated at 5.25 GHz. FIG. 56 shows a VSWR measurement chart of antenna 120 being in the third placement state and operated at 5.35 GHz. FIG. 57 shows a VSWR measurement chart of antenna 120 being in the third placement state and operated at 5.45 GHz. FIG. 58 shows a VSWR measurement chart of antenna 120 being in the third placement state and operated at 5.75 GHz. FIG. 59 shows a VSWR measurement chart of antenna 120 being in the third placement state and operated at 5.85 GHz. FIG. 60 shows a VSWR measurement chart of antenna 130 being in the third placement state and operated at 2.4 GHz. FIG. 61 shows a VSWR measurement chart of antenna 130 being in the third placement state and operated at 2.45 GHz. FIG. 62 shows a VSWR measurement chart of antenna 130 being in the third placement state and operated at 2.5 GHz. FIG. 63 shows a VSWR measurement chart of antenna 130 being in the third placement state and operated at 4.9 GHz. FIG. 64 shows a VSWR measurement chart of antenna 130 being in the third placement state and operated at 5.15 GHz. FIG. 65 shows a VSWR measurement chart of antenna 130 being in the third placement state and operated at 5.25 GHz. FIG. 66 shows a VSWR measurement chart of antenna 130 being in the third placement state and operated at 5.35 GHz. FIG. 67 shows a VSWR measurement chart of antenna 130 being in the third placement state and operated at 5.45 GHz. FIG. 68 shows a VSWR measurement chart of antenna 130 being in the third placement state and operated at 5.75 GHz. FIG. 69 shows a VSWR measurement chart of antenna 130 being in the third placement state and operated at 5.85 GHz.

Referring to FIG. 70, a table of peak gain and average gain of antenna 120 and antenna 130 in the first placement state, the second placement state and the third placement state is shown. According to the disclosure in FIGS. 7~69, the peak gain and the average gain of the antenna 120 and the antenna 130 in the first placement state, the second placement state and the third placement state are summarized in FIG. 70.

Second Embodiment

Figure 3:
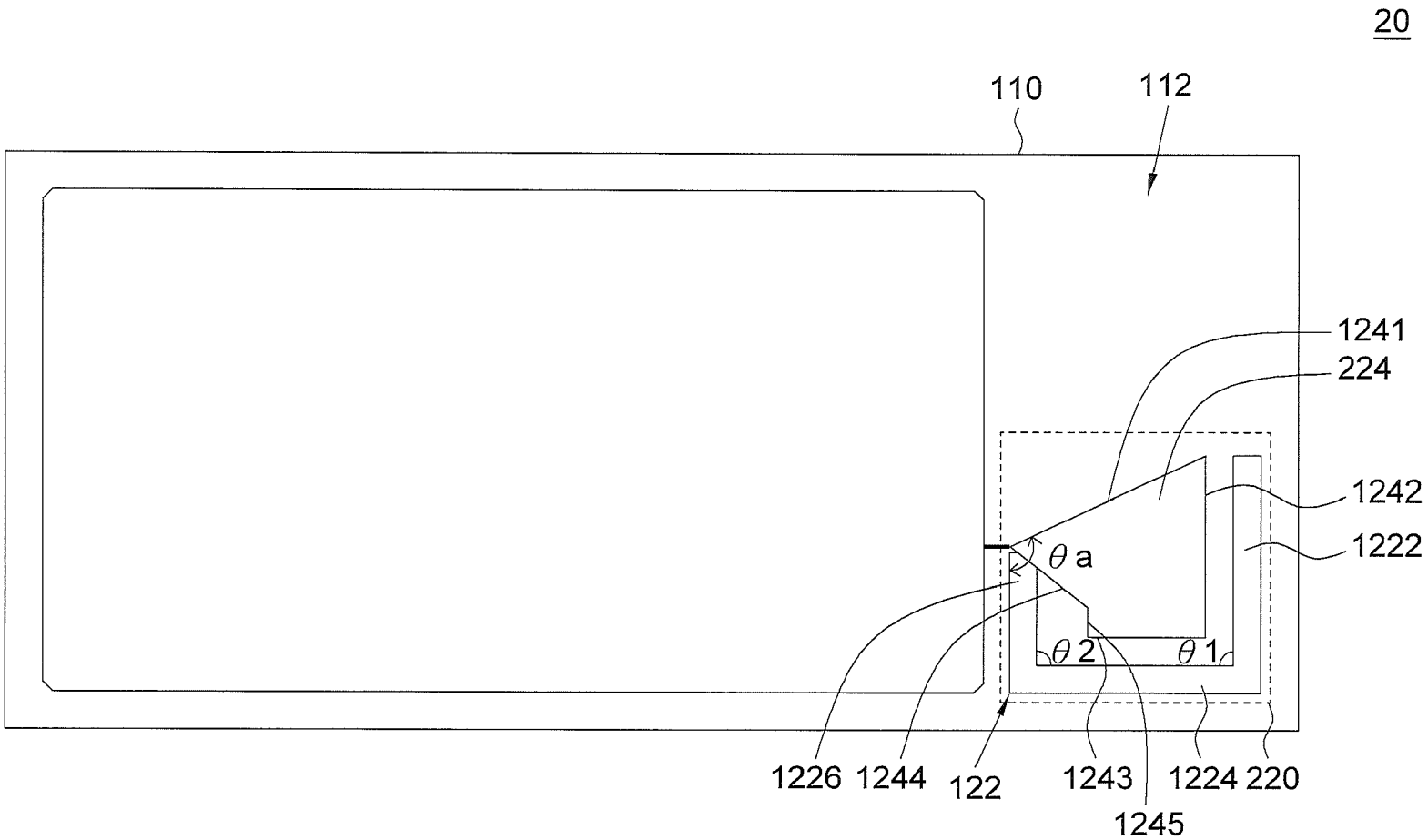
FIG. 3 shows a top view of a dual-band dual-antenna structure according to a second embodiment of the invention.
Figure 4:
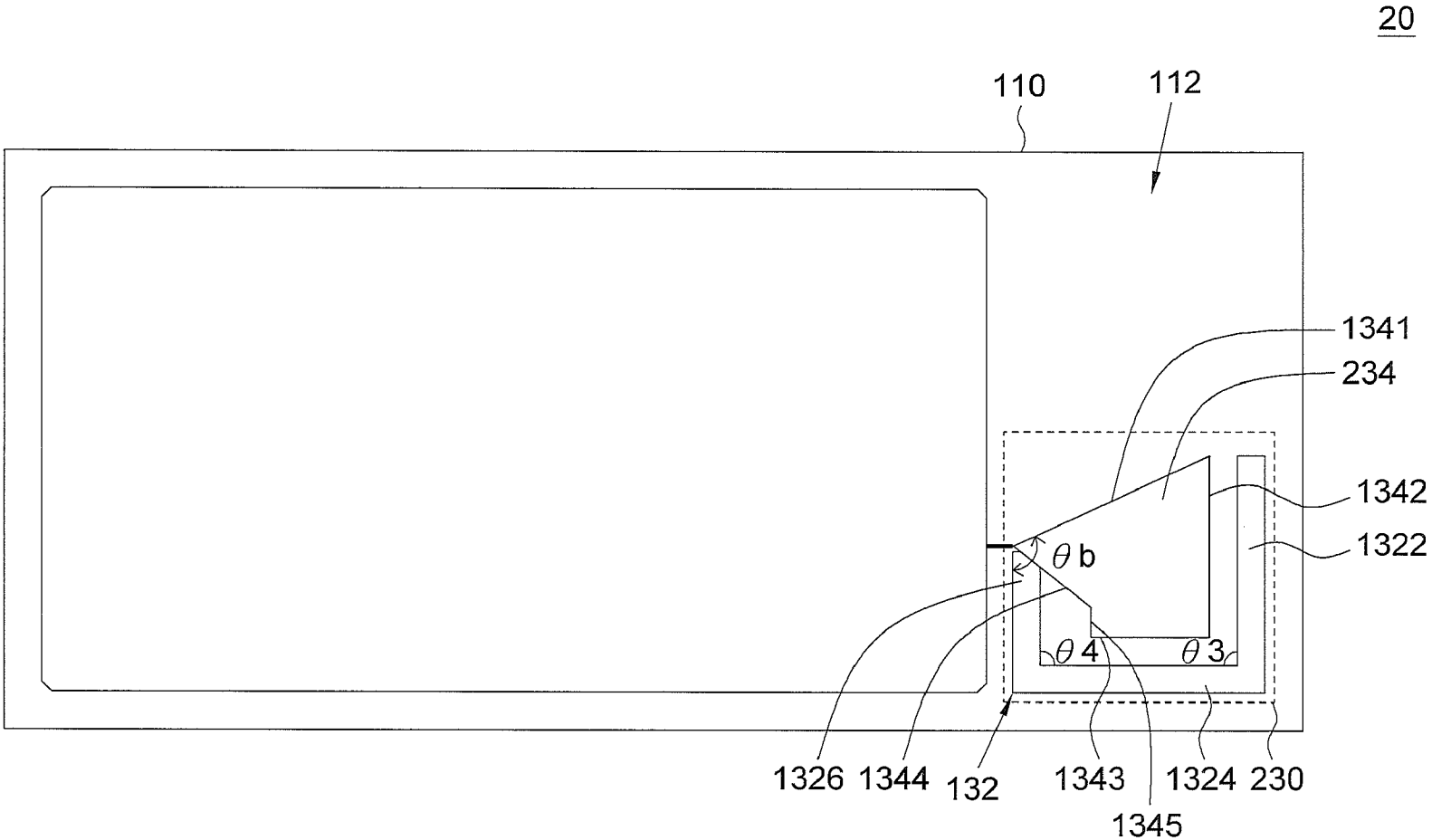
FIG. 4 shows an upward view of a dual-band dual-antenna structure according to a second embodiment of the invention.

Referring to both FIG. 3 and FIG. 4. FIG. 3 shows a top view of a dual-band dual-antenna structure according to a second embodiment of the invention. FIG. 4 shows an upward view of a dual-band dual-antenna structure according to a second embodiment of the invention. The dual-band dual-antenna structure 20 differs with the dual-band dual-antenna structure 10 in that in the second embodiment, the polygon radiation element 224 and the polygon radiation element 234 both are a recessed pentagon. A U-shaped slit is formed between the U-shaped radiation element 122 and the polygon radiation element 224, and a U-shaped slit is formed between the U-shaped radiation element 132 and the polygon radiation element 234.

Apart from the lateral sides 1241~1244, the polygon radiation element 224 further comprises a lateral side 1245 which is parallel to the lateral side 1242, wherein the one end and the other end of the lateral side 1245 are respectively connected to the other end of the lateral side 1244 and the other end of the lateral side 1243. Apart from the lateral sides 1341~1344, the polygon radiation element 234 further comprises a lateral side 1345 which is parallel to the lateral side 1342, wherein the one end and the other end of the lateral side 1345 are respectively connected to the other end of the lateral side 1344 and the other end of the lateral side 1343.

The dual-band dual-antenna structure disclosed in the above embodiments of the invention has many advantages exemplified below:

Firstly, providing dual operating frequency bands;

Secondly, being applicable to wireless area network;

Thirdly, reducing the occupied area of antenna on a substrate and conforming to the current of reduced volume required of electronic devices; and Fourthly, reducing the complexity and difficulty in circuit layout due to the reduced area occupied by the antenna.

While the invention has been described by way of example and in terms of a preferred embodiment, it is to be understood that the invention is not limited thereto. On the contrary, it is intended to cover various modifications and similar arrangements and procedures, and the scope of the appended claims therefore should be accorded the broadest interpretation so as to encompass all such modifications and similar arrangements and procedures.

What is claimed is:

1. A dual-band dual-antenna structure, comprising:

a substrate, comprising:

a first signal transport layer; and a second signal transport layer not coplanar with the first signal transport layer;

a first antenna disposed on the first signal transport layer, wherein the first antenna comprises:

a first U-shaped radiation element operated at a first frequency band, wherein the first U-shaped radiation element comprises:

a first band radiation portion;

a second band radiation portion, wherein one end of the second band radiation portion is connected to one end of the first band radiation portion so as to form a first right angle; and a third band radiation portion, wherein one end of the third band radiation portion is connected to the other end of the second band radiation portion so as to form a second right angle, and the first band radiation portion, the second band radiation portion and the third band radiation portion together form a first opening;

a first polygon radiation element operated at a second frequency band and disposed in the first opening, wherein the frequency of the second frequency band is larger than that of the first frequency band, and the first polygon radiation element comprises:

a first lateral side opposite to the first right angle, wherein one end of the first lateral side is connected to the other end of the third band radiation portion to form a first obtuse angle facing the first opening; and a second lateral side parallel to the first band radiation portion, wherein one end of the second lateral side is connected to the other end of the first lateral side; and a second antenna disposed on the second signal transport layer but not overlapping under the first antenna, wherein the second antenna comprises:

a second U-shaped radiation element operated at a third frequency band, wherein the second U-shaped radiation element comprises:

a fourth band radiation portion;

a fifth band radiation portion, wherein one end of the fifth band radiation portion is connected to one end of the fourth band radiation portion so as to form a third right angle; and a sixth band radiation portion, wherein one end of the sixth band radiation portion is connected to the other end of the fifth band radiation portion so as to form a fourth right angle, and the fourth band radiation portion, the fifth band radiation portion and the sixth band radiation portion together form a second opening;

a second polygon radiation element operated at a fourth frequency band and disposed in the second opening, wherein the frequency of the fourth frequency band is larger than that of the third frequency band, and the second polygon radiation element comprises:

a third lateral side opposite to the third right angle, wherein one end of the third lateral side is connected to the other end of the sixth band radiation portion to form a second obtuse angle facing the second opening; and a fourth lateral side parallel to the fourth band radiation portion, wherein one end of the fourth lateral side is connected to the other end of the third lateral side.

2. The dual-band dual-antenna structure according to claim 1, wherein the first antenna is smaller than 10 mm×10 mm.

3. The dual-band dual-antenna structure according to claim 1, wherein the second antenna is smaller than 10 mm×10 mm.

4. The dual-band dual-antenna structure according to claim 1, wherein a similar L-shaped slit is formed between the first U-shaped radiation element and the first polygon radiation element.

5. The dual-band dual-antenna structure according to claim 1, wherein a similar L-shaped slit is formed between the second U-shaped radiation element and the second polygon radiation element.

6. The dual-band dual-antenna structure according to claim 1, wherein a U-shaped slit is formed between the first U-shaped radiation element and the first polygon radiation element.

7. The dual-band dual-antenna structure according to claim 1, wherein a U-shaped slit is formed between the second U-shaped radiation element and the second polygon radiation element.

8. The dual-band dual-antenna structure according to claim 1, wherein the first polygon radiation element further comprises:

a fifth lateral side parallel to the second band radiation portion, wherein one end of the fifth lateral side is connected to the other end of the second lateral side.

9. The dual-band dual-antenna structure according to claim 8, wherein the first polygon radiation element further comprises:

a sixth lateral side opposite to the second right angle.

10. The dual-band dual-antenna structure according to claim 9, wherein one end of the sixth lateral side is connected to one end of the first lateral side.

11. The dual-band dual-antenna structure according to claim 9, wherein the first polygon radiation element further comprises:

a seventh lateral side parallel to the second lateral side, wherein the one end and the other end of the seventh lateral side are respectively connected to the other end of the sixth lateral side and the other end of the fifth lateral side.

12. The dual-band dual-antenna structure according to claim 1, wherein the second polygon radiation element further comprises:

a fifth lateral side parallel to the fifth band radiation portion, wherein one end of the fifth lateral side is connected to the other end of the fourth lateral side.

13. The dual-band dual-antenna structure according to claim 12, wherein the second polygon radiation element further comprises:

a sixth lateral side opposite to the fourth right angle.

14. The dual-band dual-antenna structure according to claim 13, wherein one end of the sixth lateral side is connected to one end of the third lateral side.

15. The dual-band dual-antenna structure according to claim 13, wherein the second polygon radiation element further comprises:

a seventh lateral side parallel to the fourth lateral side, wherein the one end and the other end of the seventh lateral side are respectively connected to the other end of the sixth lateral side and the other end of the fifth lateral side.

16. The dual-band dual-antenna structure according to claim 1, wherein the length of the first band radiation portion is larger than is larger than that of the third band radiation portion.

17. The dual-band dual-antenna structure according to claim 1, wherein the length of the fourth band radiation portion is larger than is larger than that of the sixth band radiation portion.

18. The dual-band dual-antenna structure according to claim 1, wherein the first antenna and the second antenna are disposed in symmetry.

19. The dual-band dual-antenna structure according to claim 1, wherein the first antenna and the second antenna are disposed at equal proportion, then the first frequency band is equal to the third frequency band, and the second frequency band is equal to the fourth frequency band.

* * * * *